US008666288B2

(12) United States Patent
Matsumoto et al.

(10) Patent No.: US 8,666,288 B2
(45) Date of Patent: Mar. 4, 2014

(54) DEVELOPING DEVICE AND IMAGE FORMING APPARATUS

(75) Inventors: Junichi Matsumoto, Kanagawa (JP); Tomoya Ohmura, Kanagawa (JP); Yasuo Takuma, Kanagawa (JP); Hiroshi Kikuchi, Kanagawa (JP); Natsumi Matsue, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 183 days.

(21) Appl. No.: 13/137,522

(22) Filed: Aug. 24, 2011

(65) Prior Publication Data

US 2012/0051792 A1 Mar. 1, 2012

(30) Foreign Application Priority Data

Aug. 26, 2010 (JP) ..... 2010-189871
Jun. 24, 2011 (JP) ..... 2011-141016

(51) Int. Cl.
*G03G 15/08* (2006.01)
*G03G 15/09* (2006.01)

(52) U.S. Cl.
USPC ..... 399/254; 399/272; 399/273

(58) Field of Classification Search
USPC ..... 399/254, 272, 273
See application file for complete search history.

(56) References Cited

U.S. PATENT DOCUMENTS

| | | | | |
|---|---|---|---|---|
| 7,783,233 | B2 | 8/2010 | Iwata et al. | |
| 2007/0264053 | A1* | 11/2007 | Iwata et al. | 399/254 |
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0028611 | A1 | 1/2009 | Matsumoto et al. | |
| 2009/0123174 | A1 | 5/2009 | Iwata et al. | |
| 2009/0317106 | A1 | 12/2009 | Ohmura et al. | |
| 2010/0061774 | A1 | 3/2010 | Iwata et al. | |
| 2010/0124443 | A1 | 5/2010 | Ohmura et al. | |
| 2010/0143000 | A1 | 6/2010 | Matsue et al. | |
| 2011/0182610 | A1 | 7/2011 | Ohmura et al. | |
| 2011/0229207 | A1 | 9/2011 | Matsumoto et al. | |

FOREIGN PATENT DOCUMENTS

| | | | | |
|---|---|---|---|---|
| JP | 2000-275943 | A * | 10/2000 | G03G 15/08 |
| JP | 3494963 | B2 | 11/2003 | |
| JP | 2005-017742 | A | 1/2005 | |
| JP | 2007-334287 | A | 12/2007 | |

(Continued)

OTHER PUBLICATIONS

English language abstract for JP-2001-109264 which corresponds to JP-3494963-B2.

(Continued)

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

A developing device in the embodiment includes: a developer carrier that carries a two-component developer, moves the surface, and supplies the toner to a latent image on a surface of a latent image carrier; a first conveying member that conveys the developer in a first conveying path; a second conveying member that conveys the developer in a second conveying path; and a developer passing unit that conveys upward the developer which has reached at a conveying-direction posterior end of the second conveying path and passes the developer to the first conveying path. The developer passing unit includes a plurality of pushing members that push up the developer. The developer can pass through from upper surfaces of the pushing members to lower surfaces of the pushing members.

18 Claims, 15 Drawing Sheets

(56) References Cited

FOREIGN PATENT DOCUMENTS

| | | | | | |
|---|---|---|---|---|---|
| JP | 2008-304846 | A | * | 12/2008 | ..... G03G 15/08 |
| JP | 2009-098286 | A | | 5/2009 | |
| JP | 4333057 | B2 | | 7/2009 | |
| JP | 4646728 | B2 | | 12/2010 | |

OTHER PUBLICATIONS

English language abstract for JP-2002-365909 which corresponds to JP-4333057-B2.

English language abstract for JP-2007-034043 which corresponds to JP-4646728-B2.

* cited by examiner

DEVELOPING DEVICE AND IMAGE FORMING APPARATUS

CROSS-REFERENCE TO RELATED APPLICATIONS

The present application claims priority to and incorporates by reference the entire contents of Japanese Patent Application No. 2010-189871 filed in Japan on Aug. 26, 2010 and Japanese Patent Application No. 2011-141016 filed in Japan on Jun. 24, 2011.

BACKGROUND OF THE INVENTION

1. Field of the Invention

The present invention relates to a developing device used in a copy machine, a facsimile machine, and a printer. More particularly, the present invention relates to a developing device that uses a two-component developer consisting of toner and a carrier and to an image forming apparatus that uses the developing device.

2. Description of the Related Art

A developing device of this type usually causes a two-component developer (hereinafter, "developer"), which is conveyed in a supplying-conveying path extending along the direction of the rotation axis of a developer carrier, to be carried on the surface of the developer carrier. By moving the two-component developer on the surface of the developer carrier, the developing device supplies the two-component developer to a developing area opposed to a latent image carrier. In the developing area, a latent image formed on the latent image carrier is developed to a visible toner image. The developer, from which toner has been consumed to develop the toner image in the developing area, is collected from the surface of the developer carrier, mixed with resupplied toner and stirred, and then re-used for further developing.

Such a developing device includes a circulating-conveying path along which the developer that has reached the conveying-direction posterior end of the supplying-conveying path is conveyed to the conveying-direction anterior end of the supplying-conveying path.

Japanese Patent No. 3494963, Japanese Patent No. 4333057, and Japanese Patent Application Laid-open No. 2009-98286 describe a configuration in which a supplying-conveying path and a circulating-conveying path, which extends along the direction of the rotation axis of a developer carrier and conveys a developer in a direction opposite to that of the supplying-conveying path, are arranged vertically. This configuration reduces the size of the developing device in the horizontal direction compared to a configuration in which the circulating-conveying path and the supplying-conveying path are arranged horizontally. This arrangement is not limited to a circulating-conveying path and a supplying-conveying path. By arranging any two developer conveying paths vertically, the size of the developing device in the horizontal direction can be reduced.

Furthermore, Japanese Patent No. 3494963 describes a developing device that includes a circulating-conveying path that is arranged above a supply conveying path and also describes a developer passing unit that conveys upward a developer that has reached a conveying-direction posterior end of a supplying-conveying path and passes the developer to the circulating-conveying path. In the configuration in which two conveying paths are arranged vertically, if passing of the developer from the lower conveying path to the upper conveying path depends on the pressure exerted by the horizontal conveying force of a conveying unit that is arranged in the lower conveying, path, the developer deteriorates easily. By providing a developer passing unit as described in Japanese Patent No. 3494963, the developer can be prevented from deteriorating when the developer is passed from the lower conveying path to the upper conveying path.

In a developing device that uses a two-component developer, in order to obtain a stable toner image, it is necessary to maintain the toner density or the charge of the toner within a predetermined range in the developer. The toner density in the developer can be adjusted by re-supplying a volume of toner corresponding to the volume of toner consumed during developing. The toner is charged by the triboelectric effect, which occurs when the carrier and the toner are mixed. By mixing the carrier and the toner sufficiently, an amount of charge within a desired range can be obtained. Even if the toner density in the developer in the developing device is within a predetermined range, but if the toner density distribution is uneven, the toner image density may also become uneven. For this reason, in the developing device, in order to make the toner density distribution even and to cause the toner to be charged by a desired amount and thus to stabilize the toner image, it is necessary to sufficiently stir the two-component developer consisting of the toner and the carrier. However, providing further additionally a stirring unit may result in a complicated or large developing device.

SUMMARY OF THE INVENTION

It is an object of the present invention to at least partially solve the problems in the conventional technology.

According to an aspect of the present embodiment, there is provided a developing device including: a developer carrier that carries, on its surface, a two-component developer consisting of a toner and a magnetic carrier, moves the surface, and supplies the toner to a latent image on a surface of a latent image carrier in a developing area in which the developer carrier is opposed to the latent image carrier, thereby developing the latent image; a first conveying member that conveys the developer in a first conveying path that is formed in a developer storage unit that stores the developer to be supplied to the developer carrier; a second conveying member that conveys the developer in a second conveying path that is formed below the first conveying path in the developer storage unit; and a developer passing unit that conveys upward the developer which has reached at a conveying-direction posterior end of the second conveying path and passes the developer to the first conveying path. The developer passing unit includes a plurality of pushing members that push up the developer by moving up, and when the pushing members push the developer, the developer can pass through from upper surfaces of the pushing members to lower surfaces of the pushing members.

According to another aspect of the present embodiment, there is provided an image forming apparatus, including: a latent image carrier that carries a latent image; a latent image forming unit that forms a latent image on the latent image carrier; and a developing unit that develops the latent image on the latent image carrier. The developing device claim 1 is applied thereto as the developing unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5A is a cross-sectional view of the developing device, taken along a line H-H in FIG. 4, and FIG. 5B is a cross-sectional view of the developing device, taken along the line I-I in FIG. 1 and FIG. 4;

FIG. 6A is a view of multiple spaces partitioned by multiple paddle blades, and FIG. 6B is a view showing that the developer moves between the partitioned spaces;

FIG. 7A is a view of an $N^{th}$ paddle blade, FIG. 7B is a view of an $N+1^{th}$ paddle blade, and FIG. 7C is a view of another example of the $N+1^{th}$ paddle blade;

FIG. 13A is a cross-sectional view of the developing device taken along the plane Q in FIG. 12, and FIG. 13A is a cross-sectional view of the developing device taken along the plane R in FIG. 12;

FIG. 18A is a cross-sectional view of the developing device, taken along the line I-I in FIG. 17, and FIG. 18B is a cross-sectional view of the developing device, taken along the line T-T in FIG. 17;

FIG. 19A is a perspective view of the developing device, and FIG. 19B is a cross-sectional view of the developing device;

DETAILED DESCRIPTION OF THE PREFERRED EMBODIMENTS

An embodiment will be described in which the present embodiment is applied to a copy machine (hereinafter, "a copy machine 500") functioning as an image forming apparatus.

Figure 2:
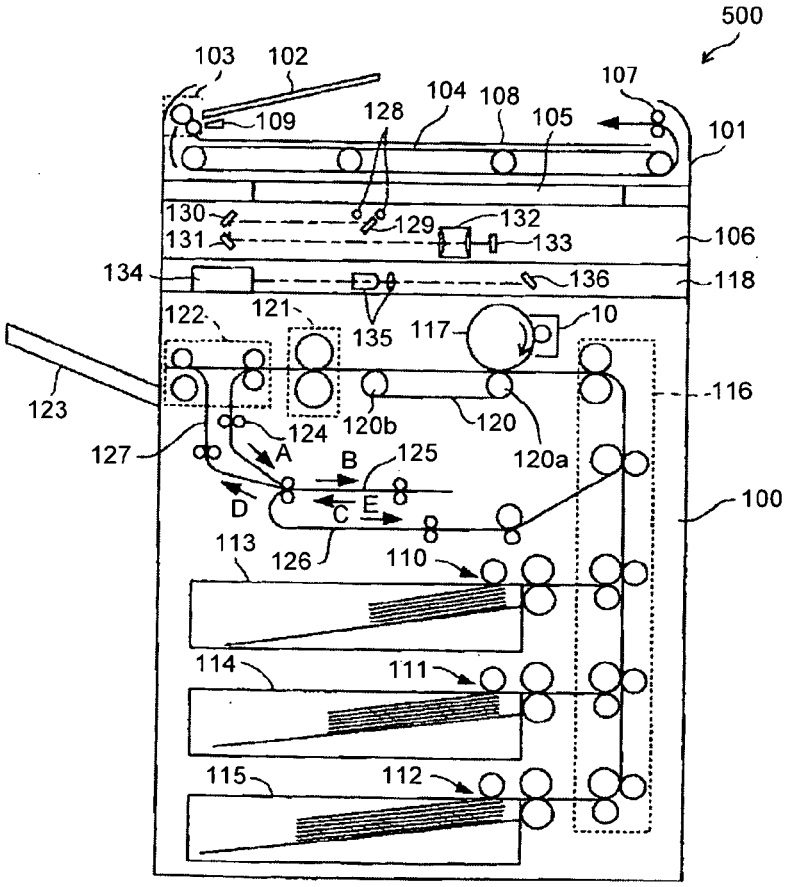
FIG. 2 is a schematic configuration diagram of a copy machine of an embodiment.

FIG. 2 is a schematic configuration diagram of the copy machine 500. The copy machine 500 includes a writing unit 118, an image scanning unit 106, and an auto document feeder (hereinafter, an ADF 101) that are positioned above a printer unit 100 that functions as the main unit of the image forming apparatus.

Operations of a copier function of the copy machine 500 will be described.

A stack of originals are placed on an original table 102 of the ADF 101 with the surfaces of the originals facing upward. Once a start key on an operation unit (not shown) is pressed down, the top original is fed to a predetermined position on an exposure glass 105 by original feeding rollers 103 and a feeding belt 104. After image information of the original on the exposure glass 105 is scanned by the image scanning unit 106, the original is conveyed by the feeding belt 104 and ejected by ejection rollers 107 onto an ejection table 108. After the feeding of the original from the original table 102 to the exposure glass 105 ends, when an original detection sensor 109 detects the next original on the original table 102, the original is fed to the exposure glass 105 in the same manner as that described above.

The image scanning unit 106 performs line scanning in a sub-scanning direction on the original information of an original on the exposure glass 105 while irradiating the original by using two lamps 128. The image scanning unit 106 reflects, as image data, the reflected light in a predetermined direction by using a first mirror 129, a second mirror 130, and a third mirror 131, and transmits the light to a CCD 133 via a lens unit 132 that forms a size-reduced image, thereby scanning the image data.

The image data scanned by the image scanning unit 106 is transmitted, via an image processing unit (not shown), to the writing unit 118 that includes a laser light emitting device 134, an fθ lens 135, and a reflecting mirror 136. The laser light emitting device 134 of the writing unit 118 then emits laser light corresponding to the original image and accordingly an electrostatic latent image corresponding to the original image is formed on a photosensitive element 117.

In the printer unit 100, the photosensitive element 117, a developing device 10, a fixing unit 121, an ejecting unit 122, first to third feeding devices 110, 111, and 112, and a vertical conveying unit 116 are arranged. The photosensitive element 117 is charged evenly by a charger (not shown) and then exposed with the laser light from the writing unit 118 so that an electrostatic latent image is formed. The electrostatic latent image is then developed by the developing device 10 and accordingly a toner image is formed on the surface of the photosensitive element 117.

The first to third feeding devices 110, 111, and 112 include first to third feeding cassettes 113, 114, and 115 respectively, on which transfer paper sheets functioning as recording media are stacked. In parallel with the above-described operation for forming a toner image, a selected one of the first to third feeding devices 110, 111, and 112 feeds the top one of the transfer paper sheets stacked on the feeding cassette to the vertical conveying unit 116. The fed transfer paper sheet is then conveyed by the vertical conveying unit 116 to a position where the photosensitive element 117 and a transfer belt 120 abut.

The transfer belt 120 is arranged below the photosensitive element 117. The transfer belt 120 functions as both a transfer unit and a conveying unit that conveys a transfer paper sheet, which in turn functions as a recording medium. The transfer belt 120 is extended by a transfer roller 120*a* and an extending roller 120*b*. A bias is applied from a power supply (not shown) to the transfer roller 120*a*, while the transfer belt 120 conveys the transfer paper sheet at the same speed as that of the photosensitive element 117, and the toner image on the photosensitive element 117 is transferred to the transfer paper sheet.

The transfer paper sheet, having passed through an area in which the photosensitive element 117 and the transfer roller 120*a* are opposed to each other, is conveyed by the transfer belt 120 to the fixing unit 121. The toner image transferred to the transfer paper sheet is fixed thereon by the fixing unit 121. The transfer paper sheet on which the image has been fixed is ejected to an ejection tray 123 via the ejecting unit 122. After the toner image is transferred, the photosensitive element 117 is cleaned by a cleaning unit (not shown) in preparation for the next image forming.

A reverse unit 125 is arranged below the ejecting unit 122. The transfer paper sheet that has been guided by a bifurcation unit (not shown), which is provided in the ejecting unit 122, is fed to the reverse unit 125 by a pair of conveying rollers 124 as indicated by the arrow A in FIG. 2.

As indicated by the arrow B in FIG. 2, the transfer paper sheet that has entered the reverse unit 125 is conveyed by the reverse unit 125 in the direction indicated by the arrow C in FIG. 2. An ejecting-conveying path 127 that returns the reversed transfer paper sheet to the ejecting unit 122 as indicated by the arrow D in FIG. 2 is provided between the reverse unit 125 and the ejecting unit 122. By ejecting the transfer paper sheet which has been reversed by the reverse unit 125 via the ejecting-conveying path 127, the transfer paper sheet can be ejected to the ejection tray 123 with the surface of the transfer paper sheet on which the image is formed facing down.

A duplex-image-forming conveying path 126 along which the transfer paper sheet, which has been reversed by the reverse unit 125, is re-conveyed to the vertical conveying unit 116 is arranged below the reverse unit 125. When images are formed on both surfaces of a transfer paper sheet, the transfer paper sheet which has been conveyed by the reverse unit 125 in the direction indicated by the arrow C in FIG. 2 is conveyed to the duplex-image-forming conveying path 126 as indicated by the arrow E in FIG. 2. The transfer paper sheet is then passed to the vertical conveying unit 116 and thus the transfer paper sheet is supplied to the area in which the photosensitive element 117 and the transfer roller 120*a* are opposed to each other and with the surface of the transfer paper sheet on which the image is formed facing downward. Accordingly, the surface of the transfer paper sheet on which no image is formed is opposed to the photosensitive element 117 and a toner image is transferred to the transfer paper sheet so that images are formed on both surfaces of the transfer paper sheet, and then the transfer paper sheet can be ejected to the ejection tray 123.

When the copy machine 500 forms an image due to printer function, external image data instead of image data from the image processing unit is input to the writing unit 118, and an image forming unit forms an image on a transfer paper sheet. When a facsimile fax function is performed, image data from the image scanning unit 106 is transmitted to a receiver by a fax transmitting/receiving unit (not shown), and image data from the receiver is received by the fax transmitting/receiving unit. The image data from the receiver, instead of image data from the image processing unit, is input to the writing unit 118; and thus the image forming unit operates and forms an image on a transfer paper sheet.

The example of a multi-function peripheral as an image forming apparatus is described for the above-described configuration. However, the image forming apparatuses to which the present embodiment can be applied is not limited to this. The present embodiment can be applied to other image forming apparatuses such as a printer, a facsimile machine, and a plotter.

EXAMPLE 1

A first example (hereinafter, Example 1) of the developing device 10 to which the present embodiment is applied will be described below.

Figure 1:
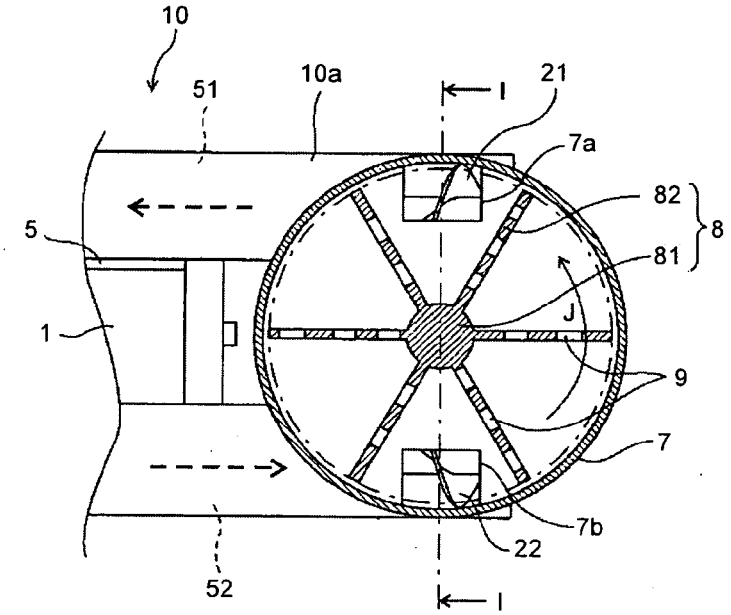
FIG. 1 is a cross-sectional view of a developer lifting unit in a developing device of Example 1.
Figure 3:
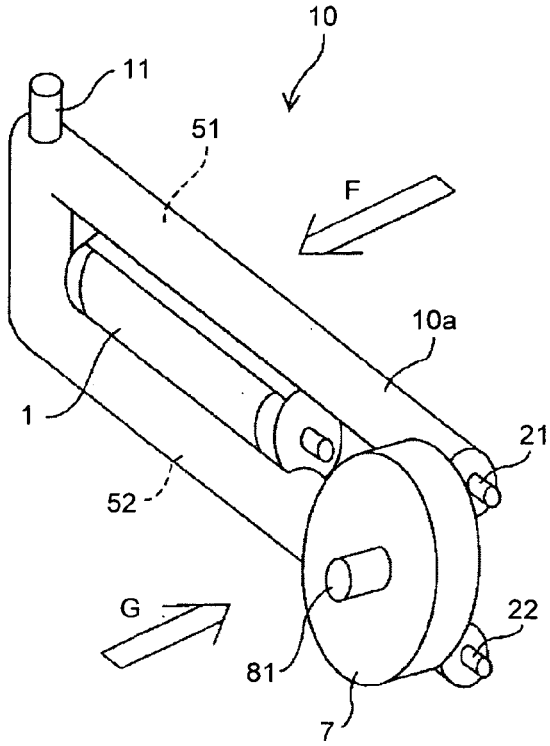
FIG. 3 is a perspective view of the developing device of Example 1.
Figure 4:
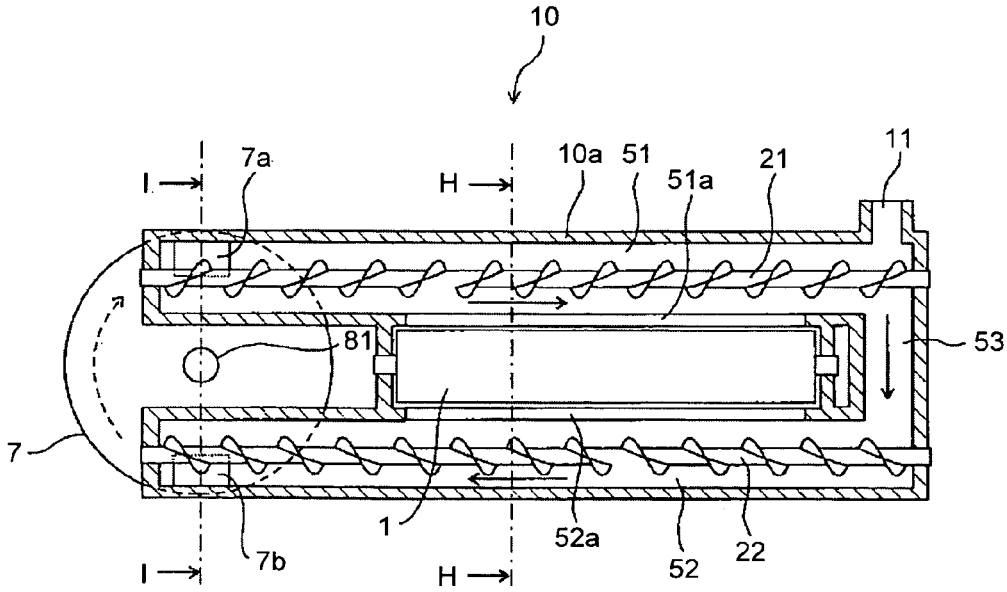
FIG. 4 is a cross-sectional view of the developing device of Example 1 and parts near the developing device.

FIG. 3 is a perspective view of the developing device 10 of Example 1 and FIG. 4 is a cross-sectional view of a developing roller 1 of the developing device 10 and parts near the developing roller 1, viewed from the direction indicated by the arrow F in FIG. 3. FIG. 1 is a cross-sectional view of a developer lifting unit 7 of the developing device 10, viewed in the direction indicated by the arrow G in FIG. 3.

Figure 5A:
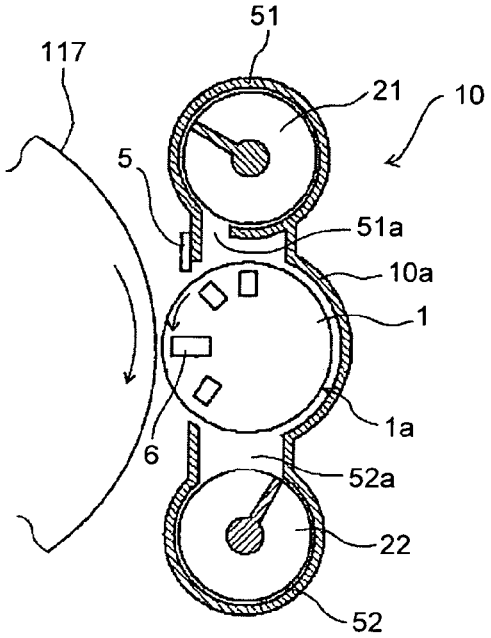
FIGS. 5A and 5B contain cross-sectional views of the developing device taken along a plane orthogonal to the rotation axis of a developing roller 1.
Figure 5B:
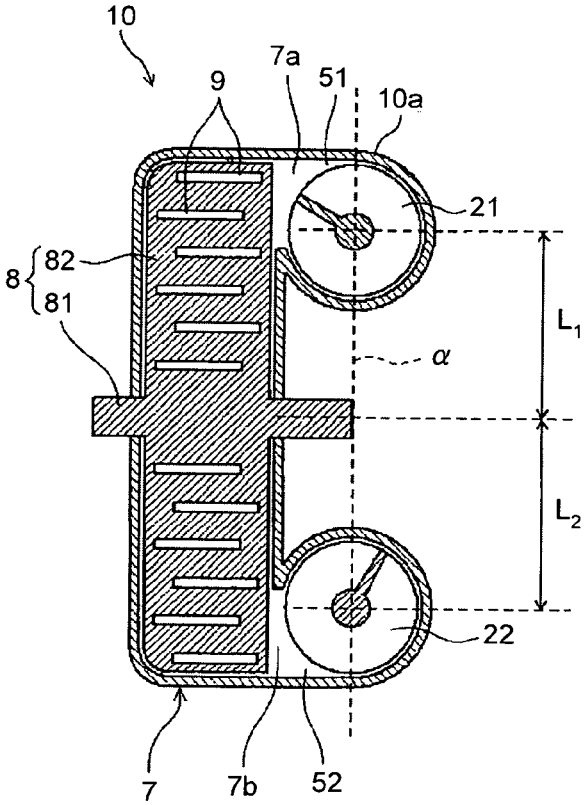

FIGS. 5A and 5B are cross-sectional views of the developing device 10 taken along the plane orthogonal to the rotation axis of the developing roller 1. FIG. 5A is a cross-sectional view of the developing device 10 taken along the line H-H in FIG. 4 in a position where the developing roller 1 is arranged; and FIG. 5B is a cross-sectional view of the developing device 10 taken along the line I-I in FIG. 1 and FIG. 4 in a position where the developer lifting unit 7 is arranged.

The developing device 10 of Example 1 is arranged to be opposed to the photosensitive element 117. The photosensitive element 117 is driven to rotate clockwise in FIG. 5A as indicated by the arrow in FIG. 5A.

A two-component developer consisting of a magnetic or nonmagnetic toner and a magnetic carrier is stored in a casing 10*a* of the developing device 10. The developing roller 1 of the developing device 10, which functions as a developer carrier, consists of a cylindrical developing sleeve 1*a* and a magnet roller 6 that consists of multiple magnets and that is fixed to the developing device 10 and arranged in the developing sleeve 1*a*. The developing roller 1 carries the developer on the surface of the developing sleeve 1*a* by using the magnetic force of the magnet roller 6. The developing sleeve 1*a* rotates and thus its surface moves and thus the toner is supplied to an electrostatic latent image, which is formed on the surface of the photosensitive element 117, and the developer is conveyed to a developing area where developing is performed. The developing device 10 further includes a doctor blade 5 functioning as a developer adjusting member that adjusts the thickness of the developer carried on the developing sleeve 1*a*.

The developing device 10 includes a supplying screw 21 that functions as a first conveying member and conveys, along the direction of the rotation axis of the developing roller 1, the developer in a supplying-conveying path 51 that functions as a first conveying path and is formed in the casing 10*a* that stores the developer to be supplied to the developing roller 1. The developing device 10 further includes a collecting screw 22 that functions as a second conveying member and conveys the developer in a collecting-conveying path 52 that functions as a second conveying path and is formed below the supplying-conveying path 51 in the casing 10*a*. The developing device 10 further includes a rotating paddle 8 that functions as a developer passing-conveying unit that conveys the developer upward, which is a rotating paddle located in the developer lifting unit 7 that communicates with a conveying-direction posterior end of the collecting-conveying path 52 via a developer inlet 7*b*. An upper part of the developer lifting unit 7 communicates with the supplying-conveying path 51 via a developer outlet 7*a*.

In the developing device 10, the supplying screw 21 and the collecting screw 22 are provided so as to be approximately parallel to the direction of the rotation axis of the developing roller 1. Each screw member includes a rotation shaft and blades that are helically provided around the rotation shaft. By rotation, each screw member conveys the developer in a single direction along the axial direction of the rotation shaft. The arrows in the casing 10*a* in FIGS. 1 and 4 denote the directions in which the developer flows.

The developer in the casing 10*a* is stored in the supplying-conveying path 51, the collecting-conveying path 52, a developer fall portion 53, and the developer lifting unit 7. The developer in the collecting-conveying path 52 is conveyed by the collecting screw 22 in the direction opposite to the conveying direction of the supplying screw 21.

The developer in the supplying-conveying path 51 is conveyed by rotation of the supplying screw 21 to the conveying-direction posterior side (right side in FIG. 4). The developer having reached a conveying-direction posterior end of the supplying-conveying path 51 falls into the developer fall portion 53 by its own weight and is passed to the collecting-conveying path 52. The developer in the collecting-conveying path 52 is conveyed by rotation of the collecting screw 22 to the conveying-direction posterior side (left side in FIG. 4). The developer having reached a conveying-direction posterior end of the collecting-conveying path 52 is passed to the developer lifting unit 7 from the developer inlet 7*b*. The developer in the developer lifting unit 7 is lifted up by paddle blades 82 of the rotating paddle 8 in the developer lifting unit 7 and conveyed from the developer outlet 7*a* to the supplying-conveying path 51. In this manner, the developer in the casing 10*a* is circulated in the device by the supplying screw 21, the collecting screw 22, and the rotating paddle 8.

As shown in FIGS. 4, 5A and 5B, the casing 10*a* forms a supplying-communicating portion 51*a* between the supplying screw 21 and the developing roller 1 and the casing 10*a* forms a collecting-communicating portion 52*a* between the collecting screw 22, and the developing roller 1. A toner resupply port 11 is provided in an upper part of the developer fall portion 53.

In a developing operation, a part of the developer conveyed by the supplying screw 21 in the supplying-conveying path 51 passes through the supplying-communicating portion 51*a* and is supplied to the surface of the developing roller 1. When the developer having supplied to the surface of the developing roller 1 passes through the portion opposed to the doctor blade 5 in accordance with the rotation of the developing sleeve 1*a*, the thickness of the developer is adjusted and the developer is conveyed to the developing area opposed to the photosensitive element 117. The supplying-communicating portion 51*a* extends in the axial direction of the developing roller 1; and accordingly the developer can be supplied across the width of the developing area from the supplying-conveying path 51 to the developing roller 1.

The developer having passed through the developing area between the developing roller 1 and the photosensitive element 117 separates from the surface of the developing roller 1, passes through the collecting-communicating portion 52*a*, and is conveyed to the collecting-conveying path 52.

As described above, in the developing device 10, some developer carried on the developing sleeve 1*a*, instead of being supplied to the surface of the photosensitive element 117 in the developing area, remains on the developing sleeve 1*a* with the density-reduced toner. This developer is not recollected in the supplying-conveying path 51 in accordance with the rotation of the developing sleeve 1*a*, but is collected in the collecting-conveying path 52. The collected developer and toner resupplied from the toner resupply port 11 are stirred while being conveyed in the collecting-conveying path 52; and the developer lifting unit 7 and the developer is passed to the supplying-conveying path 51 again.

In the copy machine 500, toner is resupplied by a toner resupplying device (not shown) from the toner resupply port 11 in accordance with the volume of the consumed toner, which is the volume known according to the image information of an electrostatic latent image formed on the photosensitive element 117. The toner resupplied into the casing 10*a* falls into the conveying-direction posterior end of the collecting-conveying path 52 and thus the toner can be resupplied to the developer in the collecting-conveying path 52. In this manner, the developer with an appropriate toner density can be passed to the supplying-conveying path 51.

In the developing device 10, not all the developer, which has been passed to the supplying-conveying path 51 from the collecting-conveying path 52 via the developer lifting unit 7, reaches the conveying-direction posterior end of the supplying screw 21 in the supplying-conveying path 51. As described above, there are components that are, while the developer is being conveyed in the supplying-conveying path 51, supplied to the surface of the developing roller 1, pass through the developing area, and then are collected in the collecting-conveying path 52. Passing of the developer to the surface of the developing roller 1 is performed across approximately the whole area along the width in the direction of the rotation axis of the developing roller 1.

For this reason, there is a tendency for the volume of the developer that is conveyed by the conveying force applied by the supplying screw 21 in the supplying-conveying path 51 to decrease gradually from the anterior end to the posterior end of the supplying-conveying path 51.

In the collecting-conveying path 52, the developer is supplied from the surface of the developing roller 1 across approximately the whole area along the width in the axial direction. For this reason, there is a tendency for the volume of the developer that is conveyed by the conveying force applied by the collecting screw 22 to increase gradually from the anterior end to the posterior end in the collecting-conveying path 52. In other words, there is unevenness in the distribution of the volume of the developer in the casing 10*a* in the developing device 10.

As shown in FIG. 5A, the developing device 10 of Example 1 has a configuration in which the developing roller 1, the supplying screw 21, and the collecting screw 22 are arranged in a line vertically. The developer lifting unit 7 is arranged in a position near the conveying-direction anterior end of the supplying screw 21 and near the conveying-direction posterior end of the collecting screw 22. The rotating paddle 8 arranged in the developer lifting unit 7 is arranged such that a paddle rotation shaft 81 is orthogonal to a virtual plane $\alpha$ connecting the rotation axes of the two screw members.

As shown in FIG. 1, the inside of the developer lifting unit 7 is partitioned into multiple spaces by the paddle blades 82 of the rotating paddle 8. The rotating paddle 8 rotates and accordingly the divided spaces rotate on the paddle rotation shaft 81. The developer lifting unit 7 is provided with the developer inlet 7*b* and the developer outlet 7*a*. Because one of the spaces is in the position in which the developer inlet 7*b* is provided, the developer having reached the conveying-direction posterior end of the collecting-conveying path 52 flows into one of the partitioned spaces from the developer inlet 7*b*. The space into which the developer has flowed rotates on the paddle rotation shaft 81 and accordingly the developer in the space also rotates. When the developer reaches the position in which the developer outlet 7*a* is provided, the developer in the space is ejected from the developer outlet 7*a* to the supplying-conveying path 51. Accordingly, the developer having reached the conveying-direction posterior end of the collecting-conveying path 52, which is arranged below the developing roller 1, can be passed to the conveying-direction anterior end portion of the supplying-conveying path 51, which is arranged above the developing roller 1.

As shown in FIG. 1, each of the paddle blades 82 is partly provided with communication ports 9 each communicating between two spaces partitioned by the paddle blades 82.

Figure 6A:
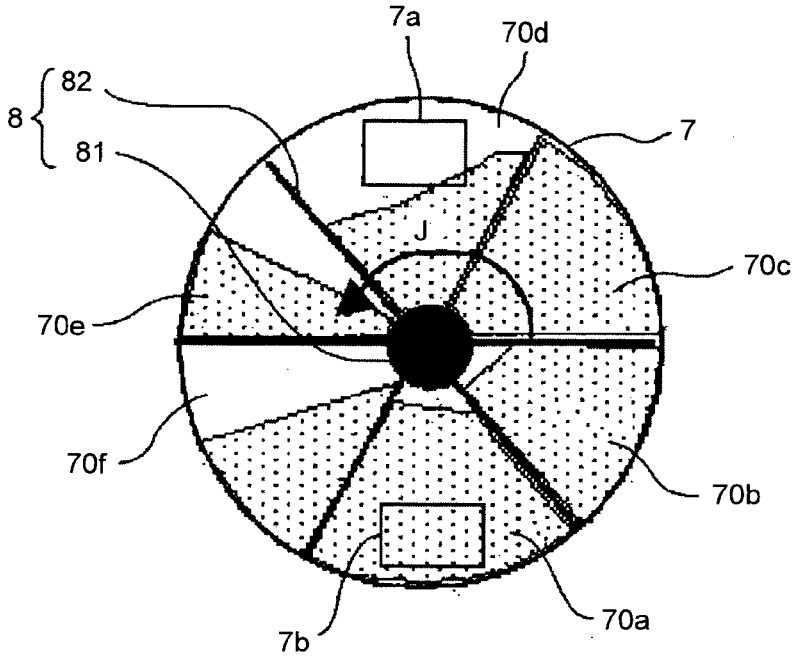
FIGS. 6A and 6B contain views schematically showing a developer in a developer lifting unit.
Figure 6B:
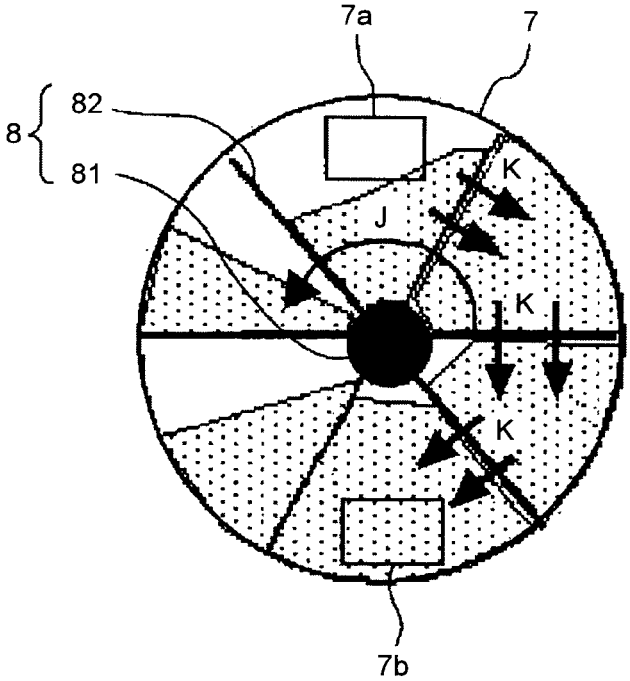

FIGS. 6A and 6B contain views schematically showing the developer in the developer lifting unit 7 at a point in time when the developing device 10 is in operation. FIG. 6A is a view of the multiple spaces partitioned by the multiple paddle blades 82 of the rotating paddle 8 and FIG. 6B is a view showing that the developer moves between the partitioned spaces.

The developer flows from the collecting-conveying path 52 into a space 70*a* in FIG. 6A via the developer inlet 7*b*. Because of the developer remaining in the spaces 70*a*, 70*b*, and 70*c* and the developer passed from the collecting-conveying path 52, there is an increased volume of the developer in the spaces 70*a*, 70*b*, and 70*c*. The developer is ejected from a space 70*d* to the supplying-conveying path 51 via the developer outlet 7*a*. The developer that was not ejected from spaces 70*e* and 70*f* when they are opposed to the developer outlet 7*a* remain in the spaces 70*e* and 70*f*.

As indicated by the arrow J in FIGS. 6A and 6B, when the rotating paddle 8 rotates and thus the developer is lifted by the paddle blades 82, a part of the developer passes through the communicating ports 9 of the paddle blades 82 as indicated by the arrows K in FIG. 6B. In other words, a part of the developer is not lifted by the paddle blades 82 but stored in the spaces.

In the developer lifting unit 7, the rotating paddle blades 82 allow conveying of the developer, which has reached the conveying-direction posterior end of the collecting-conveying path 52, to the supplying-conveying path 51. In addition, the communicating ports 9 of the paddle blades 82 allow stirring of the developer in the developer lifting unit 7 because the developer, which has passed through the communicating ports 9, is mixed with the developer posterior with respect to the communicating ports 9. Furthermore, friction occurs between the developer that passes through the communicating ports 9 and the developer that does not pass through the communication ports 9 and between the developer that has passed through the communicating ports 9 and the developer posterior with respect to the communicating ports 9, which helps to charge the toner.

The developer obtained by mixing the toner and the carrier is stored in the developing device 10 of Example 1. The developing device 10 uses a system known as a single-direction circulation system, in which the developer in the supplying-conveying path 51 is conveyed by the supplying screw 21 from the left to the right in FIG. 4 and most of the developer is supplied to the surface of the developing roller 1 while the developer is being conveyed in the supplying-conveying path 51. The developer is then adjusted to an even thickness by the doctor blade 5 and makes contact with the photosensitive element 117. Accordingly, the electrostatic latent image on the photosensitive element 117 is developed with the toner and a toner image is formed. Because the toner image is developed and the toner density in the developer decreases accordingly, new toner is supplied from the toner resupply port 11.

The developer, which has passed through the developing area and is on the surface of the developing roller 1, is all passed to the collecting-conveying path 52 and is conveyed by the collecting screw 22 leftward in FIG. 4. The developer, which has been conveyed by the collecting screw 22, flows into the developer lifting unit 7 from the developer inlet 7*b* that is provided to the conveying-direction posterior end of the collecting-conveying path 52. The resupplied toner that is resupplied from the toner resupply port 11 and having passed through the collecting-conveying path 52 also flows into the developer lifting unit 7. The developer having flowed into the developer lifting unit 7 is conveyed upward by the rotation of the rotating paddle 8. Because the paddle blades 82 are provided with the communicating ports 9, a part of the developer having flowed into the space between the paddle blades 82 passes through the communication ports 9 and falls and moves over the paddle blades 82 to a space on the anterior side. As a result, friction occurs among the developer itself, and between the developer and the paddle blades 82; therefore, the developer is stirred and triboelectric charging helps to charge the resupplied toner.

Figure 7A:
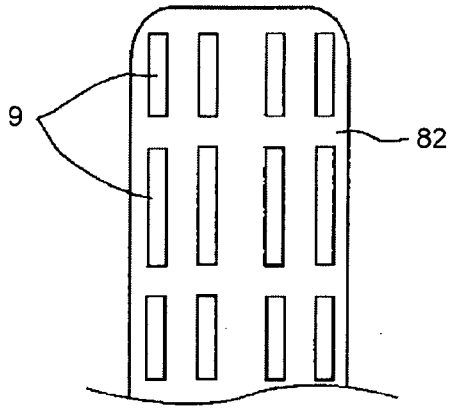
FIGS. 7A to 7C contain views of examples of formations of communicating ports of the paddle blades.
Figure 7B:
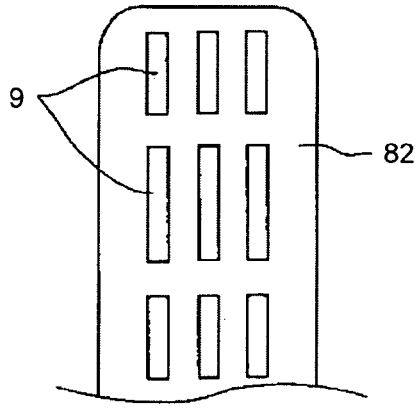
Figure 7C:
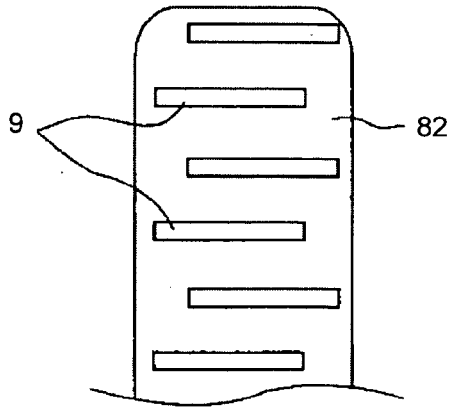

FIGS. 7A to 7C are views of examples of formations of the communicating ports 9 of the paddle blades 82. FIG. 7A is a view of the arrangement of the communicating ports 9 of an $N^{th}$ paddle blade 82 with respect to a certain position; and FIG. 7B is a view of the arrangement of the communicating ports 9 of an $N+1^{th}$ paddle blade 82 with respect to the certain position. As shown in FIGS. 7A to 7C, the communicating ports 9 are formed so as not to be in overlapping positions between adjacent paddle blades 82.

As described above, because the positions of the communicating ports 9 formed in the adjacent paddle blades 82 vary, the developer having passed through the communicating ports 9 of the $N^{th}$ paddle blade 82 is prevented from directly passing through the communicating ports 9 of the $N+1^{th}$ paddle blade 82 (anterior with respect to the $N^{th}$). This helps other developer to pass through the communicating ports 9 of the $N+1^{th}$ paddle blade 82 (anterior with respect to the $N^{th}$) and a movement in the axial direction of the paddle rotation shaft 81 is applied the developer that is moving in the rotation direction of the rotating paddle 8. This improves stirring of the developer and improves charging of the resupplied toner.

FIG. 7C is a view of another example of an arrangement of the communication ports 9 of the $N+1^{th}$ paddle blade 82 with respect to the certain position. As shown in FIG. 7C, the pattern of arranging the communicating ports 9 can be varied from that of the $N^{th}$ paddle blade 82.

In the developing device 10, as shown in FIGS. 1 and 5B, the outer diameter of the rotating paddle 8 is set larger than the distance between the rotation axes of the two screw members. Accordingly, the conveyed volume per rotation of the rotating paddle 8 can be increased and the rotation speed of the rotating paddle 8 can be set low.

In addition, the developer lifted by the rotating paddle 8 in the developer lifting unit 7 is passed from the developer outlet 7*a* to the supplying-conveying path 51 and is circulated in the casing 10*a*.

In the developing device 10, by providing the developer lifting unit 7 that uses the rotating paddle 8, the developer can be circulated easily even if the collecting-conveying path 52 and the supplying-conveying path 51 are in separate vertical positions. Accordingly, as shown in FIGS. 3, 5A and 5B, the two screw members and the developing roller 1 can be arranged in a straight line vertically, which significantly reduces the size of the developing device 10 in its width direction.

In the developing device 10, providing that the rotation number of the supplying screw 21 is R1 [rps], the rotation number of the rotating paddle 8 is R2 [rps], and the number of paddle blades is N, the relation is set to satisfy N×R2>R1, where "N×R2" denotes the frequency of the paddle blades 82 and "R1" denotes the frequency of the blades (spiral pitch) of the supplying screw 21.

The developer that is supplied to the supplying-conveying path 51 by the rotating paddle 8 of the developer lifting unit 7 tends to vary with the frequency "N×R2" of the paddle blades 82. The screw pitch of the supplying screw 21 also tends to vary. If the frequency of the paddle blades 82 is smaller than the frequency of the screw pitch, there are both the screw pitch variation and the frequency variation of the paddle blades 82 and accordingly the variation in the period due to the paddle blades 82 remains as unevenness in conveying of the developer that is conveyed by the supplying screw 21.

The conveyance unevenness of the supplying screw 21 leads to a variation, after the developer passes through the doctor blade 5, in the volume of the developer to be supplied to the developing roller. This may cause density unevenness in the toner image and the image quality may deteriorate.

Accordingly, by increasing the frequency of the paddle blades 82 so that it is sufficiently large to be at least equal to or more than the rotation number of the supplying screw 21, the effect of the period variation of the paddle blades 82 can be removed when the developer is conveyed to the supplying screw 21.

Here, it is provided that the volume of the flow of the developer conveyed near the conveying-direction posterior end of the collecting screw 22 is Q[g/s] and the volume of the flow of the developer conveyed near the conveying-direction anterior end of the supplying screw 21 is V[g/s]. To balance the volume of the developer in the developing device 10, Q=V needs to be satisfied. Providing that the volume of the developer lifted by the developer lifting unit 7 from the collecting-conveying path 52 to the supplying-conveying path 51 is S[g/s], S needs to be equal to Q and V.

However, in the developer lifting unit 7, the communicating ports 9 with which the paddle blades 82 are provided allow a part of the developer in the spaces partitioned by the paddle blades 82 to fall. Accordingly, a part of the developer having passed from the collecting-conveying path 52 to the developer lifting unit 7 is left in the developer lifting unit 7. In other words, Q=V=S is not satisfied. In order to satisfy Q=V=S, the developer is stored beforehand in the developer lifting unit 7 and the rotation rate of the rotating paddle 8 is set such that the volume of the developer conveyed upward by the rotating paddle 8 is more than Q and V.

Figure 8:
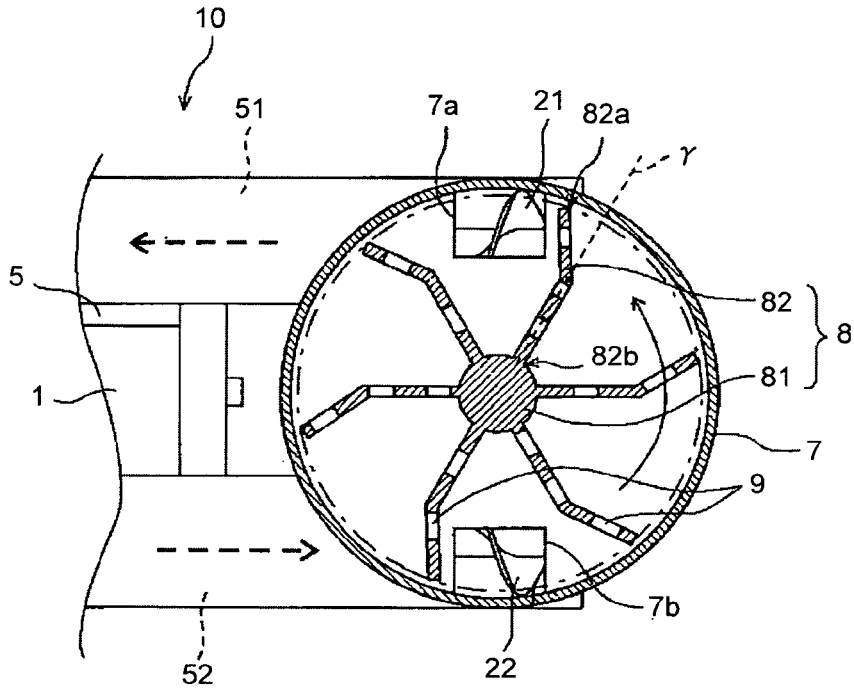
FIG. 8 is a view of a developing device including paddle blades shaped differently from Example 1.

FIG. 8 is a view of a configuration with the paddle blades 82 having a shape different from that of the developing device 10 of Example 1.

As shown in FIG. 1, the paddle blades 82 of the developing device 10 in Example 1 are shaped to extend linearly in the radial direction of the rotating paddle 8 from the position in which the paddle blades 82 are fixed to the paddle rotation shaft 81.

In contrast, in the developing device 10 shown in FIG. 8, the tips of the paddle blades 82 are curved in the rotation direction. In other words, the paddle blades 82 are shaped such that the positions of outer circumferential ends 82*a* are on the rotation-direction posterior side with respect to a virtual line γ extending in the radial direction of the rotating paddle 8 from a base portion 82*b*, which is fixed to the paddle rotation shaft 81. This shape allows the developer, which has been conveyed from the collecting-conveying path 52 to the developer lifting unit 7, to be easily taken into the spaces between the paddle blades 82.

Here, problems in conventional developing devices will be described.

There are conventional developing devices that use a supplying-collecting integration system in which a developer, from which toner has been consumed in a developing area, is returned to a supplying-conveying path on a developer carrier and collected. In a developing device that uses the supplying-collecting integration system, the toner density in the developer that is conveyed in the supplying-conveying path is low on the conveying-direction posterior side. This leads to a drawback in that, in the developer supplied to the developing area, unevenness occurs in the toner density distribution in the direction of the rotation axis of the developer carrier. The unevenness in the toner density distribution tends to appear as density unevenness in an image formed on a recording member.

Figure 22:
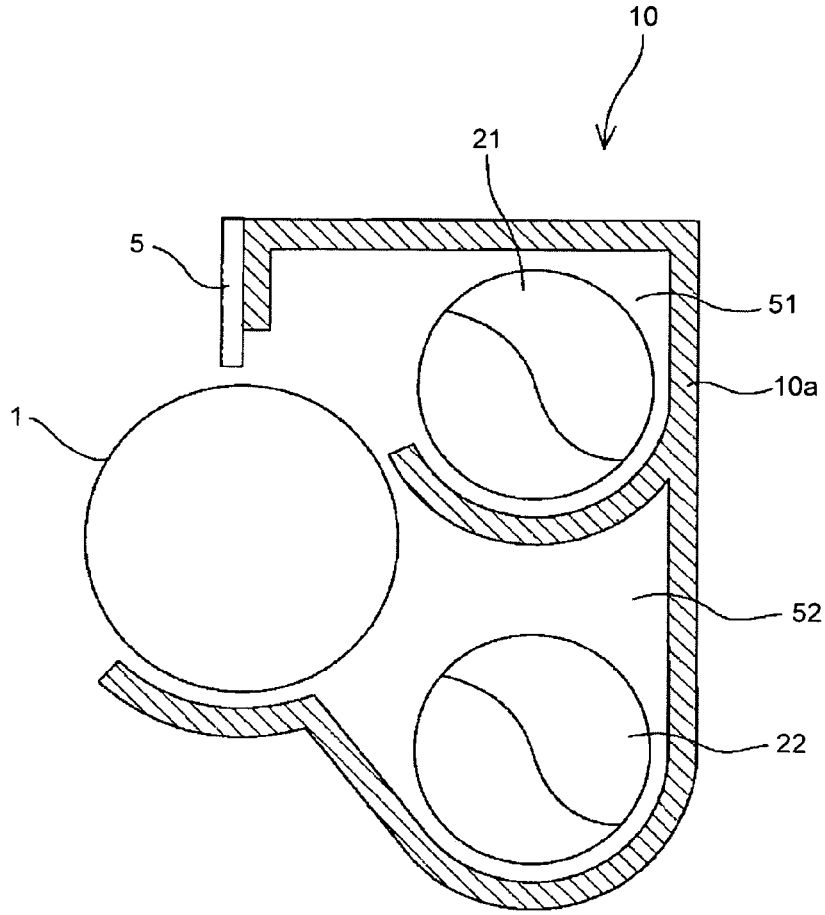
FIG. 22 is a schematic cross-sectional view of a developing device of conventional example, taken along a plane orthogonal to the axial direction.
Figure 23:
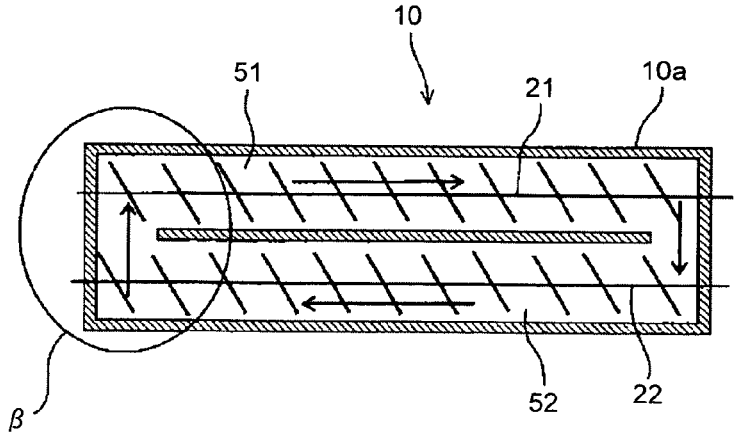
FIG. 23 is a schematic cross-sectional view of the developing device of a conventional example, taken along a plane parallel to the axial direction.

The developing device 10 shown in FIGS. 22 and 23 is a developing device (hereinafter, "the developing device 10 of Conventional Example") that can solve the above-described problem.

The developing device 10 of Conventional Example uses a supplying-collecting separation system in which a developer, from which toner has been consumed in a developing area, is collected in the collecting-conveying path 52, which is a conveying path different from the supplying-conveying path 51. In the developing device that uses the supplying-collecting separation system, the toner density in the developer that flows through the supplying-conveying path 51 is maintained even in the direction in which the developer is conveyed. Accordingly, in the developer supplied to the developing area, toner density unevenness does not occur in the direction of the rotation axis of the developing roller 1, which is a developer carrier, and occurrence of density unevenness in an image due to the above-described unevenness in the toner density distribution can be prevented.

In some conventional developing devices, in the short length of time in which resupplied toner is supplied to the developing roller, the toner is dispersed and charged by using the stirring effect of the rotation of the screws that are arranged in parallel with the developing roller and that convey the developer. For this reason, there is a risk that the resupplied toner is supplied to the developing roller while the toner is not sufficiently dispersed and this leads to a quality problem regarding, for example, stains or toner dispersion.

In the developing device 10 of Conventional Example shown in FIGS. 22 and 23, because the supplying screw 21 and the collecting screw 22 are arranged vertically, the length of the cross section of the developing device 10 in the width direction (horizontal direction) orthogonal to the axial direction is reduced, which is advantageous in reducing the size of the developing device. However, the size reduction of the developing device 10 reduces the capacity for holding the developer. When the capacity for holding the developer in the developing device 10 is reduced and if toner is resupplied in accordance with a certain volume of consumed toner, the volume of toner tends to be large compared with the case when a large-capacity developing device is used and accordingly the toner dispersion tends to deteriorate as described above.

In the developing device in which the two conveying paths are arranged vertically, there is a portion in which the developer is raised against the force of gravity as indicated in the area β of the developing device 10 of Conventional Example in FIG. 23. Regarding this portion, the developer is stored in the conveying-direction posterior end of the collecting-conveying path 52 and the developer is pushed up by the horizontal conveying force of the collecting screw 22; therefore, pressure is applied and this easily deteriorates the developer. In this configuration in which the developer is pressurized and raised, the two conveying paths need to be in adjacent to each other. This is because of the following reasons: there is no member for raising the developer in a portion that communicates between the two conveying path and in which the screw member is not arranged; and, if two conveying paths are arranged in separate vertical positions, the developer cannot be raised by pressure alone and the collecting screw 22 becomes clogged and locked.

A developing device is proposed in Japanese Patent No. 4333057 in which, in order to reduce the pressure applied to the developer when the developer is passed from the lower conveying path to the upper conveying path, a blade is provided to a raising unit to assist the raising of the developer, thereby reducing the pressure applied to the developer. However, in this method, the effect of reducing the pressure is limited and the positional relation between the upper and lower screws is also limited. According to Japanese Patent No. 3494963, an inner magnet roller is used to raise the developer from the lower conveying path to the upper conveying path. This configuration does not limit the positional relation between the screws but it raises costs.

The developing device of Conventional Example in FIGS. 22 and 23 and the developing devices in Japanese Patent No. 3494963 and Japanese Patent No. 4333057 do not have a configuration that improves stirring of the developer in a portion in which the developer is raised.

In contrast, because the developing device 10 of Example 1 is provided with the developer lifting unit 7 that uses the rotating paddle 8, even if the vertical positions of the collecting-conveying path 52 and the supplying-conveying path 51 are separated, the developer can be circulated easily. Furthermore, the communicating ports 9 provided to the paddle blades 82 of the rotating paddle 8 improves stirring of the developer in the portion in which the developer is lifted.

A developer passing unit, like the rotating paddle 8 of the developing device 10 of Example 1, that includes multiple pushing members that push up the developer and that are provided with communicating portions that allow the developer to pass from the upper surfaces of the pushing members to the lower surfaces of the pushing members can be applied to the portion in which the developer is raised, which is the portion described in Japanese Patent No. 3494963 Japanese Patent No. 4333057.

The developing device described in Japanese Patent No. 3494963 has a supplying-collecting integration system in which a developer having been supplied from a supplying-conveying path to a developer roller passes through a developing area and is re-collected in the supplying-conveying path. Furthermore, a circulating-conveying path is provided above the supplying-conveying path such that the developer having reached the conveying-direction posterior end of the supplying-conveying path is raised to be passed to the circulating-conveying path arranged above the supplying-conveying path. To this configuration of the developing device that uses the supplying-collecting integration system that includes the circulating-conveying path above the supplying-conveying path, the developer passing unit of the present embodiment can be applied as a configuration in which a developer having reached the conveying-direction posterior end of a supplying-conveying path is passed to a circulating-conveying path.

The developing device described in Japanese Patent No. 4333057 uses the supplying-collecting integration system that includes a circulating-conveying path below a supplying-conveying path. The developer passing unit of the present embodiment can be applied to this configuration as a configuration in which a developer having reached the conveying-direction posterior end of a circulating-conveying path is passed to the supplying-conveying path.

Furthermore, the present embodiment can also be applied to a developing device that uses the supplying-collecting separation system in which a supplying-conveying path and a collecting-conveying path are arranged vertically and a developing roller and two screw members are not arranged in a line vertically. The developer passing unit of the present embodiment can be applied to this configuration as a configuration in which a developer having reached the conveying-direction posterior end of a collecting-conveying path is passed to the supplying-conveying path.

EXAMPLE 2

A second example (hereinafter, "Example 2") of the developing device 10 to which the present embodiment is applied will be described below.

Figure 9:
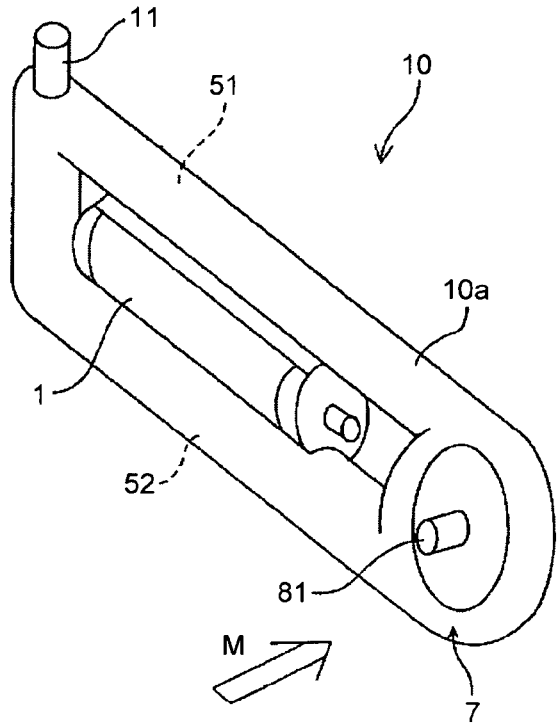
FIG. 9 is a perspective view of a developing device of Example 2.
Figure 10:
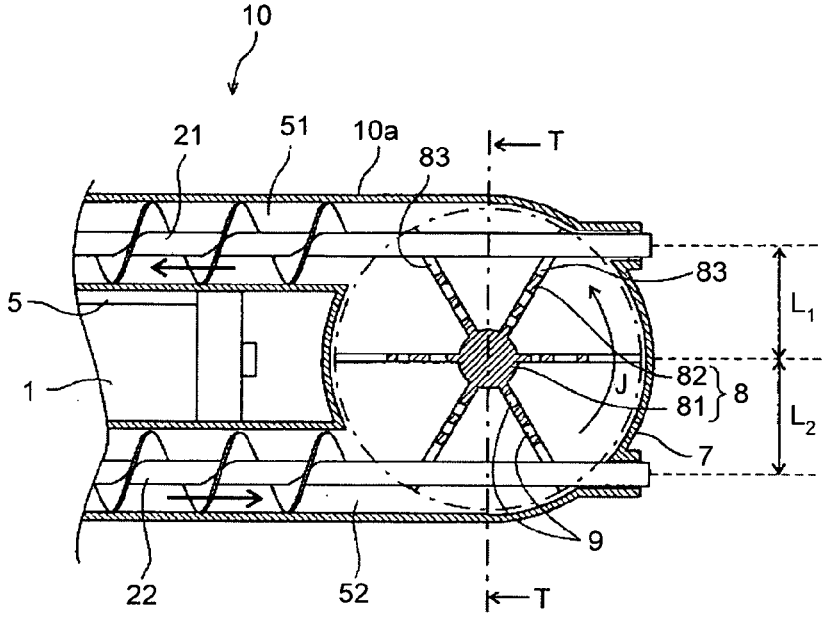
FIG. 10 is a cross-sectional view of a developer lifting unit of the developing device of Example 2.

FIG. 9 is a perspective view of the developing device 10 of Example 2; and FIG. 10 is a cross-sectional view of the developer lifting unit 7 of the developing device 10 and parts near the developer lifting unit 7, viewed from the direction indicated by the arrow M in FIG. 9.

Figure 11:
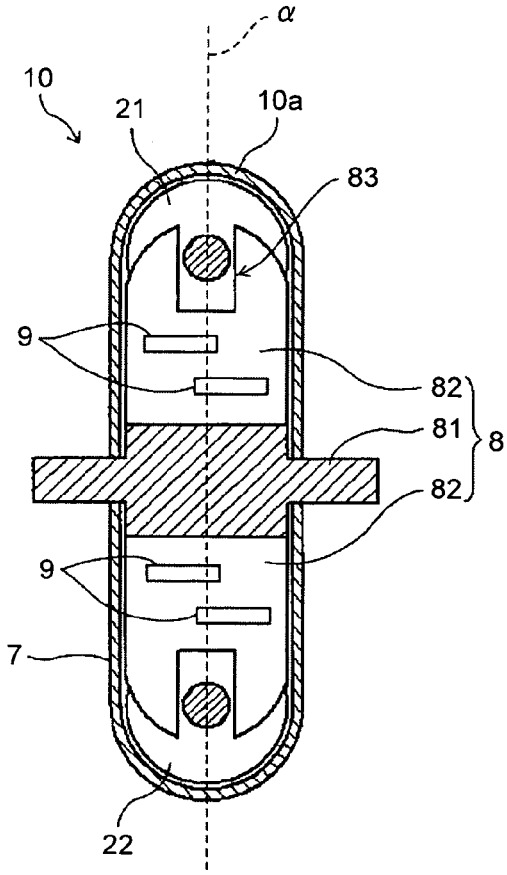
FIG. 11 is a cross-sectional view of the developing device of Example 2, taken along the line T-T in FIG. 10.

FIG. 11 is a cross-sectional view of the developer lifting unit 7 taken along the line T-T in FIG. 10 that is the plane orthogonal to the rotation axis of the developing roller 1.

The developing device 10 of Example 2 has a configuration in which a center position 2 configured such that the center position of the rotating paddle 8 in the axial direction approximately coincides with the position of a virtual plane α connecting the rotation shafts of the two screw members. The mechanism for circulating the developer is the same as that in Example 1.

In the developing device 10 of Example 1, because the supplying screw 21, the developing roller 1, and the collecting screw 22 are arranged in a line vertically in the position where the developing roller 1 is arranged, the size of the developing device 10 in the width direction can be reduced. However, in order for provision of the rotating paddle 8, the developer lifting unit 7 is formed on a width-direction outer side with respect to the supplying-conveying path 51 and the collecting-conveying path 52, which limits the size reduction in the width direction in the position where the developer lifting unit 7 is provided. In contrast, in the developing device 10 in Example 2, the rotating paddle 8 is arranged such that its width-direction position overlap the width-direction positions of the supplying screw 21, the developing roller 1, and the collecting screw 22; therefore, compared to the configuration in Example 1, the width-direction size can be reduced in the position where the developer lifting unit 7 is provided.

Furthermore, as shown in FIGS. 10 and 11, in the developing device 10 in Example 2, the ends of the paddle blades 82 are provided with cutouts 83 such that paddle blades 82 do not make contact with the rotation shafts of the two screw members.

EXAMPLE 3

A third example (hereinafter, "Example 3") of the developing device 10 to which the present embodiment is applied will be described below.

Figure 12:
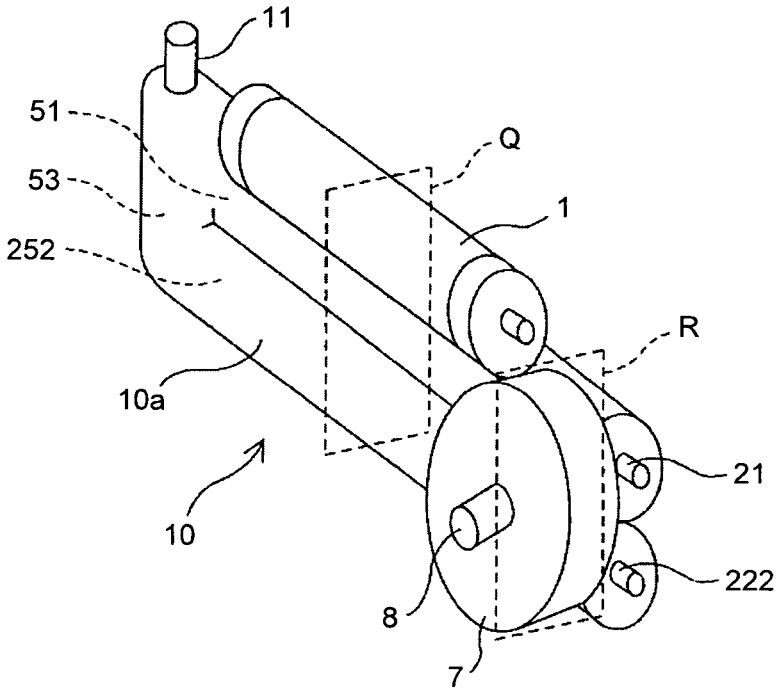
FIG. 12 is a perspective view of a developing device of Example 3.
Figure 13A:
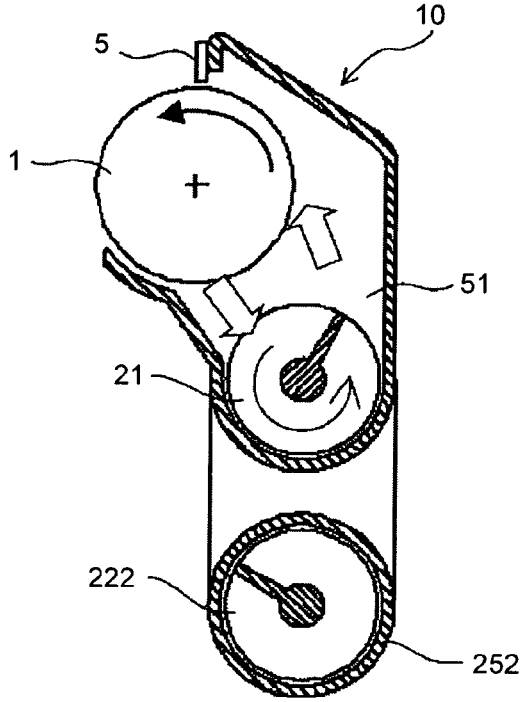
FIGS. 13A and 13B contain cross-sectional views of the developing device of Example 3.
Figure 13B:
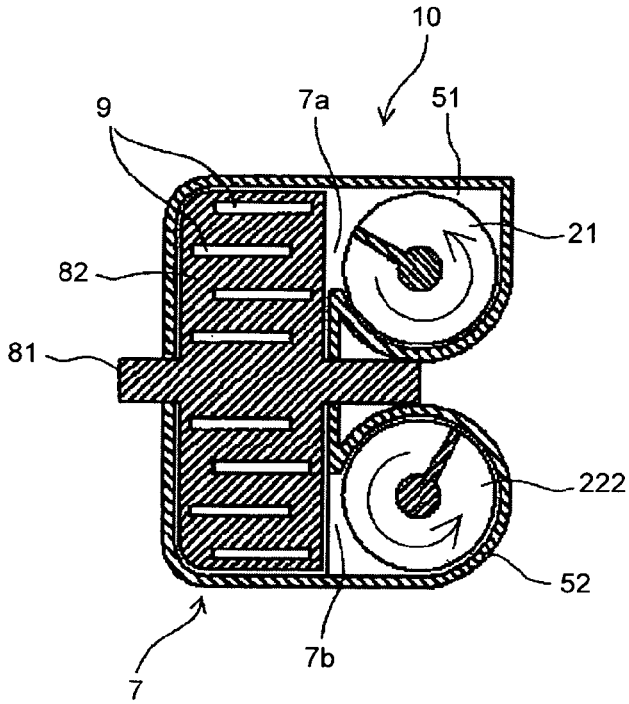

FIG. 12 is a perspective view of the developing device 10 of Example 3; and FIGS. 13A and 13B are cross-sectional views of the developing device 10 of Example 3 in FIG. 12. FIG. 13A is a cross-sectional view of the developing device 10 taken along a plane Q in FIG. 12; and FIG. 13B is a cross-sectional view of the developing device 10 taken along a plane R in FIG. 12.

The developing device 10 of Example 3 has the supplying-collecting integration system in which a circulating-conveying path 252 is positioned below the supplying-conveying path 51 and the supplying screw 21 and the collecting screw 22 are arranged in parallel with the developing roller 1.

In the developing device 10 of Example 3, the supplying screw 21 is arranged to be lower than and oblique to the developing roller 1 and a circulating screw 222 is arranged vertically below the supplying screw 21.

A two-component developer consisting of a magnetic or nonmagnetic toner and a magnetic carrier is stored in the casing 10*a* of the developing device 10. Regarding the developer that is conveyed by the supplying screw 21 in the supplying-conveying path 51, the developer adsorbed by the magnetic force of the magnets in the developing roller 1 is conveyed, in accordance with the movement of the surface of the developing roller 1, toward a developing area where the photosensitive element 117 (not shown in FIGS. 12, 13A and 13B) and the developing roller 1 are opposed to each other. While being conveyed to the developing area, the developer carried on the surface of the developing roller 1 is adjusted to an even thickness by the doctor blade 5 and then the developer makes contact with the photosensitive element 117. Accordingly, an electrostatic latent image on the photosensitive element 117 is developed with the toner and a toner image is formed.

The developer, which has passed through the developing area, on the surface of the developing roller 1 is re-collected in the supplying-conveying path 51 and conveyed toward the conveying-direction posterior end of the supplying screw 21 while being mixed with the developer in the supplying-conveying path 51 by the supplying screw 21. The conveying-direction posterior end of the supplying screw 21 in the supplying-conveying path 51 communicates with a circulating-conveying path 252, in which a circulating screw 222 is arranged, via the developer fall portion 53. Accordingly, the developer having reached the conveying-direction posterior end of the supplying screw 21 in the supplying-conveying path 51 is passed to the circulating-conveying path 252.

Toner is resupplied from the toner resupply port 11 in accordance with the volume of the consumed toner, which is the volume obtained according to the image information of the electrostatic latent image, and the toner, together with the developer that is passed from the supplying-conveying path 51 to the circulating-conveying path 252, is passed to the conveying-direction anterior end of the circulating screw 222 in the circulating-conveying path 252.

The developer is conveyed by the circulating screw 222 while being mixed with the re-supplied toner, reaches the conveying-direction posterior end of the circulating screw 222 in the circulating-conveying path 252, and is passed to the developer lifting unit 7 from the developer inlet 7*b* in FIG. 13B.

The rotating paddle 8 consists of the paddle rotation shaft 81 and the multiple paddle blades 82 that function as pushing members. Rotation of the paddle rotation shaft 81, which is connected to a drive motor (not shown), causes the paddle blades 82 to rotate and the developer is conveyed upward in accordance with the rotation. The paddle blades 82 are provided with the communicating ports 9 through which the developer can pass and, when the developer is pushed by the paddle blades 82, a part of the developer passes through the communication ports 9 and the reset of the developer moves upward. As a result, friction occurs between the developer and the developer, and between the developer and the paddle blades 82; therefore, the developer is stirred and the toner is triboelectrically charged.

The communicating ports 9 are formed so as not to be in overlapping positions between adjacent paddle blades 82 and the positions of the communicating ports 9 in the adjacent paddle blades 82. This prevents the developer, which has passed through the communicating ports 9, from directly passing through the communicating ports 9 of the next paddle blade 82; therefore, the stirring effect can be improved.

Providing that the volume of the flow of the developer conveyed near the conveying-direction posterior end of the circulating screw 222 is Q[g/s] and the volume of the flow of the developer conveyed near the conveying-direction anterior end of the supplying screw 21 is V[g/s], in order to balance the volume of the developer in the developing device 10, Q=V needs to be satisfied. Providing that the volume of the developer lifted by the developer lifting unit 7 from the circulating-conveying path 252 to the supplying-conveying path 51 is S[g/s], S needs to be equal to Q and V.

However, in the developer lifting unit 7, the communicating ports 9 provided in the paddle blades 82 allow a part of the developer in the spaces partitioned by the paddle blades 82 to fall. Accordingly, a part of the developer having passed from the circulating-conveying path 252 to the developer lifting unit 7 is left in the developer lifting unit 7. In other words, Q=V=S is not satisfied. In order to satisfy Q=V=S, the developer is stored beforehand in the developer lifting unit 7 and the rotation speed of the rotating paddle 8 is set such that the volume of the developer conveyed upward by the rotating paddle 8 is more than Q and V.

The developer lifted by the paddle blades 82 is passed into the supplying-conveying path 51 via the developer outlet 7*a* and, while being conveyed to the supplying screw 21, is re-supplied to the developing roller 1. Like the developing device of Japanese Patent No. 4333057, the developing device 10 of Example 3 has the supplying-collecting integration system, which is an example of not the single-direction circulation system but a re-supplying system. However, if the conveying screws are arranged vertically as those in the developing device of Japanese Patent No. 4333057, a pressure is required to raise the developer from the lower conveying screw to the upper conveying screw and this leads to a problem in that a stress is applied to the developer like the problem in the developing device having the supplying-collecting separation system using single-direction circulation. In contrast, by providing the developer lifting unit 7 that includes the rotating paddle 8, which functions as a rotating member, as in the case of the developing device 10 of Example 3, even the developing device having the supplying-collecting integration system can have preferable efficiency of conveying the developer the lifting unit and improve stirring of the developer.

EXAMPLE 4

A fourth example (hereinafter, "Example 4") of the developing device 10 to which the present embodiment is applied will be described below.

Figure 14:
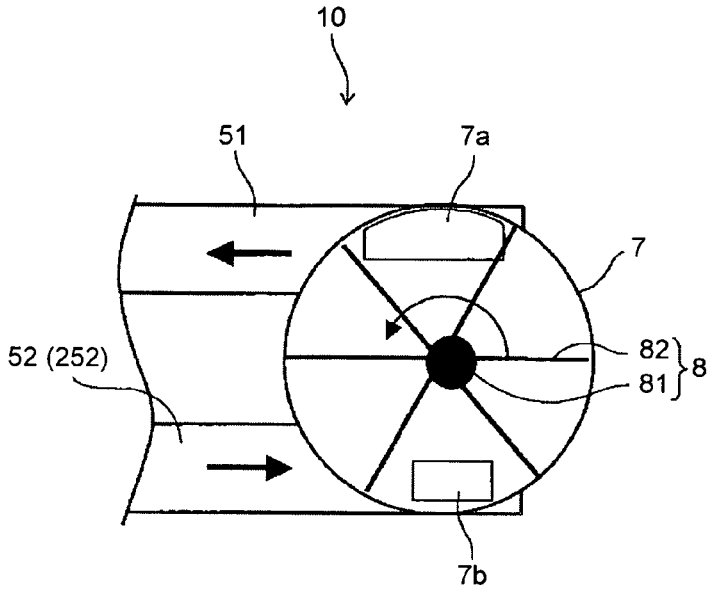
FIG. 14 is a schematic view of a developer lifting unit of a developing device of Example 4 and parts near the developer lifting unit.

FIG. 14 is a schematic view of the developer lifting unit 7 of the developing device 10 of Example 4 and parts near the developer lifting unit 7.

In Examples 1 to 3 described above, the developer outlet 7*a* and the developer inlet 7*b* have an approximately equal size. The size of the developer outlet 7*a* may be lager than that of the developer inlet 7*b*. In Example 4, as shown in FIG. 14, $S_1>S_2$ is satisfied where $S_1$ [$mm^2$] is the aperture area of the developer outlet 7*a* and $S_2$ [$mm^2$] is the aperture area of the developer inlet 7*b*.

If, for example, a paddle that helps conveying of the developer in the direction orthogonal to the axial direction of the collecting screw 22 (circulating screw 222) is provided, when the developer is passed from the collecting-conveying path 52 (circulating-conveying path 252) to the developer lifting unit 7, the volume of the conveyed developer (passed developer) R[g/s] in the developer inlet 7*b* can be approximately equal to the volume of the developer conveyed in the axial direction of the collecting screw 22 (circulating screw 222).

On the other hand, regarding the volume U[g/s] of the developer, which is conveyed from the developer lifting unit 7 to the developer supplying-conveying path 51, in the developer outlet 7*a*, the direction in which the developer is conveyed by the paddle blades 82 is different from the direction in which the developer is passed from the developer lifting unit 7 to the supplying-conveying path 51; therefore R>Q is highly likely to be satisfied.

In contrast, in the developing device 10 of Example 4, the aperture area of the developer outlet 7*a* is large to satisfy $S_1>S_2$, which increases the frequency in which the developer is passed from the developer lifting unit 7 to the developer supplying-conveying path 51; therefore, R[g/s]=U[g/s] can be kept satisfied without reducing the volume of the conveyed developer.

EXAMPLE 5

A fifth example (hereinafter, "Example 5") of the developing device 10 to which the present embodiment is applied will be described below.

Figure 15:
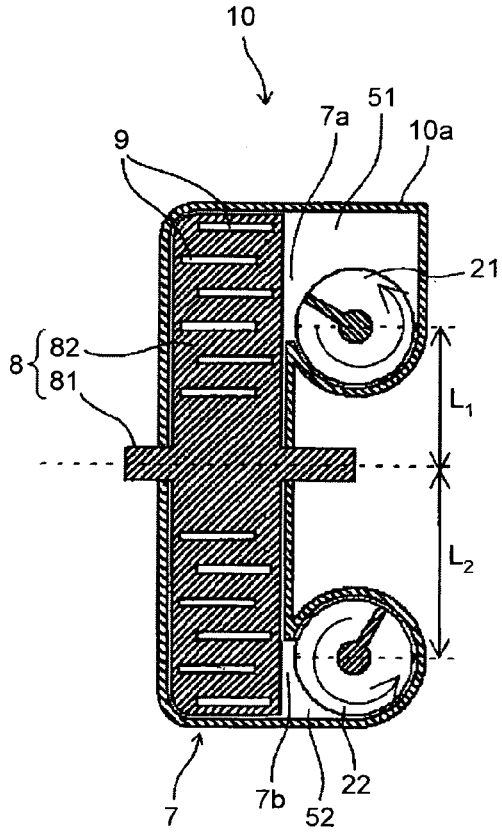
FIG. 15 is a cross-sectional view of a developing device of Example 5.

FIG. 15 is a cross-sectional view of the developing device 10 of Example 5, taken along a line as in the case of FIG. 5B.

The developing device 10 of Example 5 is different from the developing device 10 of Examples 1 in the positional relation between the two conveying screws (21, 22) and the paddle rotation shaft 81, and the configuration excluding this positional relation is in common with Example 1; therefore, only the difference will be described.

While the developing device 10 of Example 1 satisfies $L_1=L_2$ where $L_1$ is the distance between the shaft center of the supplying screw 21 and the shaft center of the paddle rotation shaft 81; and $L_2$ is the distance between the shaft center of the collecting screw 22 and the shaft center of the paddle rotation shaft 81, the developing device 10 of Example 5 satisfies $L_1<L_2$.

By applying the above-describe shaft positions, the upper end of the rotating paddle 8 is positioned above the upper end of the supplying screw 21. Accordingly, when the ends of the paddle blades 82 rotate and reach the vicinity of the top, the developer flows to and overlays on the supplying screw 21 in a way that it can be passed from the rotating paddle 8 to the supplying screw 21. Accordingly, the sufficient volume of the developer can be conveyed by the supplying screw 21 in the supplying-conveying path 51.

The volume [g/s] of the developer conveyed by the conveying screw is proportional to the level of the developer in the screw member. The volume of the conveyed developer tends to increases as the level of the developer increases. As in the case of the developing devices 10 of Examples 1, 2, and 5 having the single-direction circulation system, the volume of the developer in the supplying-conveying path 51 decreases toward the conveying-direction posterior side of the supplying screw 21 and there is a risk that the developer is depleted near the conveying-direction posterior end. In order to compensate the depletion, the rotation number of the supplying screw 21 is set higher. However, the increase in the rotation number may cause heat generation and increase the stress on the developer (toner). In the developing device 10 of Example 5, the sufficient volume of developer to fill the supplying screw 21 can be passed (lifted) in the conveying-direction anterior end of the supplying screw 21 in the supplying-conveying path 51. Accordingly, the performance of the supplying screw in conveying the developer at a certain rotation number can be utilized at maximum, which reduces the number of screw revolutions.

EXAMPLE 6

A sixth example (hereinafter, "Example 6") of the developing device 10 to which the present embodiment is applied will be described below.

Figure 16:
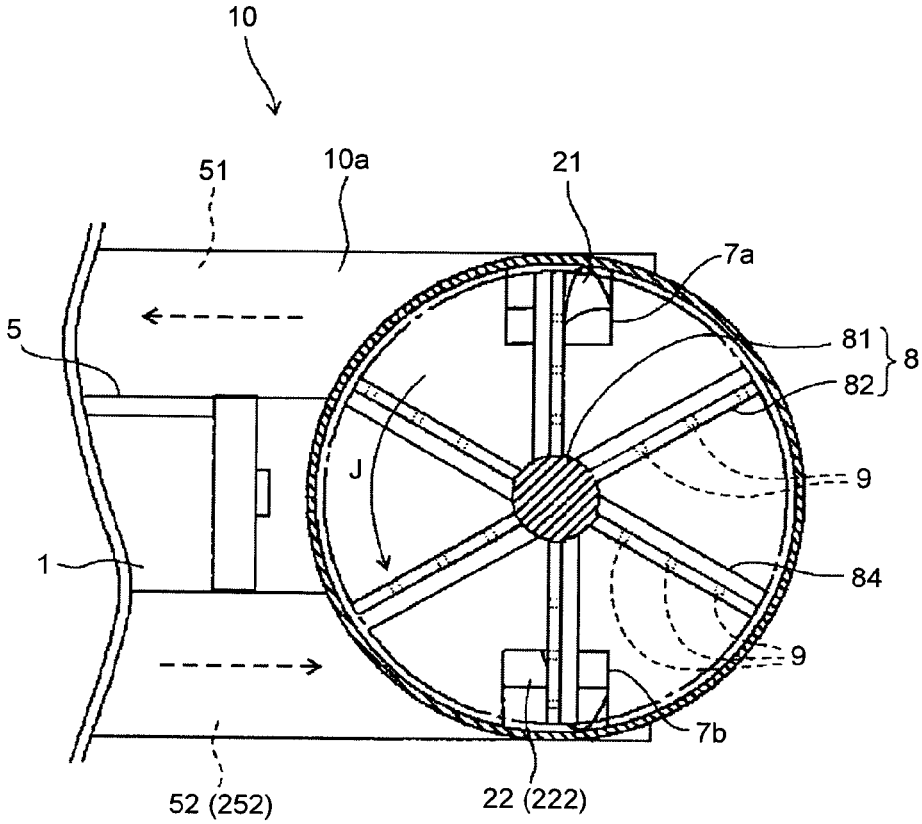
FIG. 16 is a schematic view of a developer lifting unit of a developing device of Example 6 and parts near the developer lifting unit.

FIG. 16 is a cross-sectional view of the developer lifting unit 7 of the developing device 10 of Example 6 and parts near the developer lifting unit 7, taken along the same direction as that of FIG. 1. While FIG. 1 shows the cross section of an approximately center portion of the developer lifting unit 7 in its width direction (the axial direction of the paddle rotation shaft 81), which is the cross section orthogonal to the paddle rotation shaft 81, FIG. 16 shows a cross section of a front end of the developer lifting unit 7 in its width direction in a position in which no cross-section of the paddle blades 82 is shown.

As shown in FIG. 16, in the developing device 10 of Example 6, the ends of the paddle blades 82 in their width direction distant from the developer outlet 7*a* (the front ends in FIG. 16) curves to the rotation-direction posterior side and form blade end curve portions 84. The configuration excluding the blade end curve portions 84 is in common with FIG. 1; therefore descriptions thereof will be omitted.

Because the developing device 10 of Example 6 includes the blade end curve portions 84, a speed component from the developer lifting unit 7 toward the supplying-conveying path 51 can be applied to the developer, which has been lifted by the rotating paddle 8 from the collecting-conveying path 52 (the circulating-conveying path 252), in the portion (the developer outlet 7*a*) where the developer is passed from the developer lifting unit 7 to the supplying-conveying path 51. This improves the efficiency of conveying the developer from the developer lifting unit 7 to the supplying-conveying path 51 and thus favorable developer circulation can be achieved.

EXAMPLE 7

A seventh example (hereinafter, "Example 7") of the developing device 10 to which the present embodiment is applied will be described below.

Figure 17:
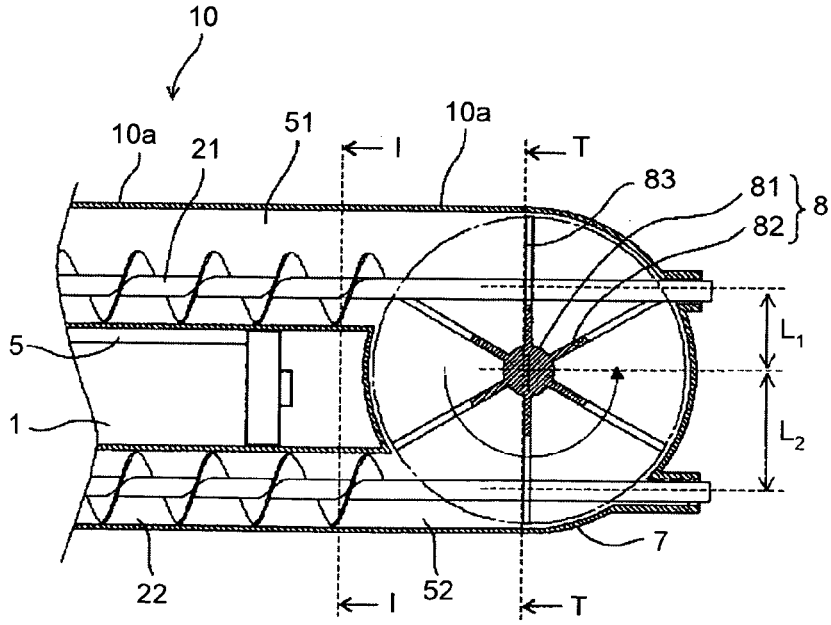
FIG. 17 is a cross-sectional view of a developing device of Example 7, taken along a plane parallel to the rotation axis.
Figure 18A:
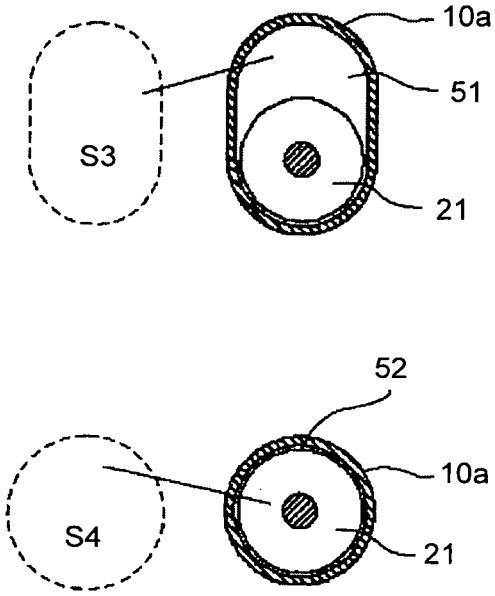
FIGS. 18A and 18B contain cross-sectional views of the developing device of Example 7, taken along planes orthogonal to the rotation axis.
Figure 18B:
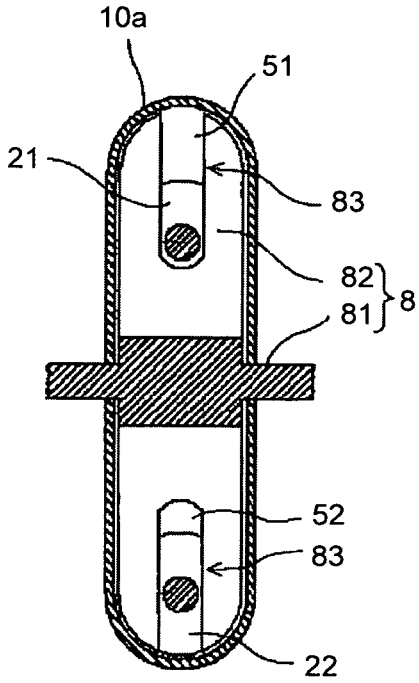

FIG. 17 is a cross-sectional view of the developing device 10 of Example 7, taken along a line as in the case of FIG. 10. FIGS. 18A and 18B are cross-sectional views of the developing device 10 of Example 7, taken along a plane orthogonal to the rotation axis of the developing roller 1. FIG. 18A is a cross-sectional view of the developing device 10 in the position where the developing roller 1 is arranged, taken along the line I-I in FIG. 17; and FIG. 18B is a cross-sectional view of the developing device 10 in the position where the developer lifting unit 7 is arranged, taken along the line T-T in FIG. 17.

While the developing device 10 of Example 2 in FIG. 10 satisfies $L_1=L_2$ where $L_1$ is the distance between the shaft center of the supplying screw 21 and the shaft center of the paddle rotation shaft 81; and $L_2$ is the distance between the shaft center of the collecting screw 22 and the shaft center of the paddle rotation shaft 81, the developing device 10 of Example 7 satisfies $L_1<L_2$. In addition, as shown in FIG. 18A, the developing device 10 of Example 7 satisfies S3>S4, where S3 is a cross-sectional area of the supplying-conveying path 51 and S4 is a cross-sectional area of the collecting-conveying path 52.

The developer, which has flowed into the developer lifting unit 7 from the collecting-conveying path 52 along the axial direction of the collecting screw 22, is lifted by the rotating paddle blades 82 along the circular casing of the developer lifting unit 7. The developer, which has been lifted upward in the developer lifting unit 7, is thrown by a centrifugal force in a way that it is supplied into the supplying-conveying path 51.

The developer moves by a motion of rotation from the conveying-direction posterior end of the collecting-conveying path 52 to the conveying-direction anterior end of the supplying-conveying path 51 via the developer lifting unit 7; therefore, no extra pressure (stress) is applied to the developer while being passed between the conveying screw and the rotation member and the developer can be circulated preferably.

The paddle blades 82 are provided with cutouts 83 that keep off the screw shafts of the supplying screw 21 and the collecting screw 22. When the paddle blades 82 rotate, the developer is sheared between the screw shafts and the paddle blades 82, which disperses the developer and helps triboelectric charging of the toner. Furthermore, like the communicating ports 9, the cutouts 83 allow a part of the developer to fall when the paddle blades 82 lift the developer and this also helps dispersion (stirring) of the developer.

Satisfying $L_1<L_2$ increase the aperture area of the cutouts 83; and the area in which the communicating ports 9 can be provided in the paddle blade 82 is reduced compared to the developing device 10 of Example 2; therefore, the communicating ports 9 are not provided in Example 7. However, because of the increase in the aperture area of the cutouts 83, the volume of the developer that passes through the cutout 83 becomes larger than that of the developing device 10 of Example 2; therefore, developer can be sufficiently stirred without providing the communicating ports 9.

EXAMPLE 8

An eighth example (hereinafter, "Example 8") of the developing device 10 to which the present embodiment is applied will be described below.

Figure 19A:
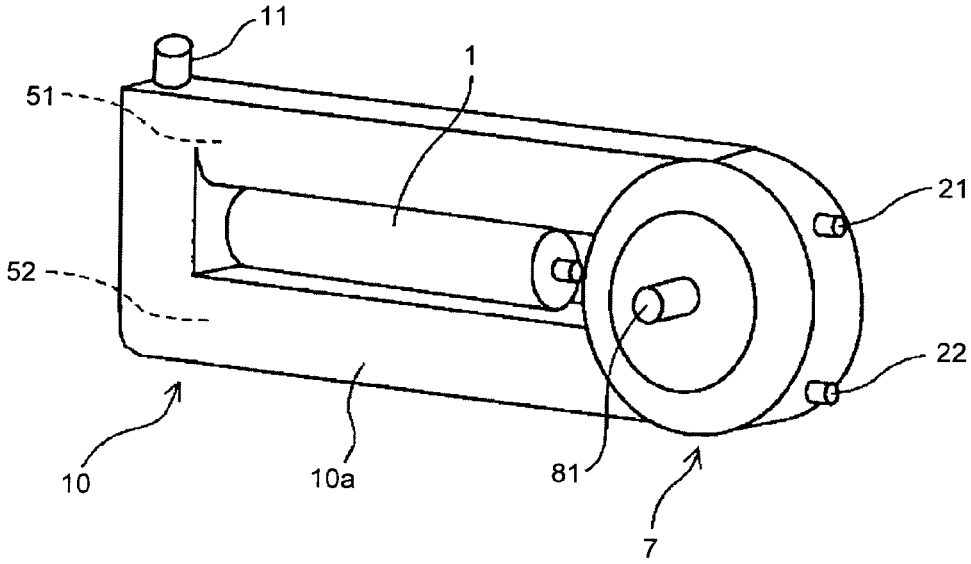
FIGS. 19A and 19B contain views of a developing device of Example 8.
Figure 19B:
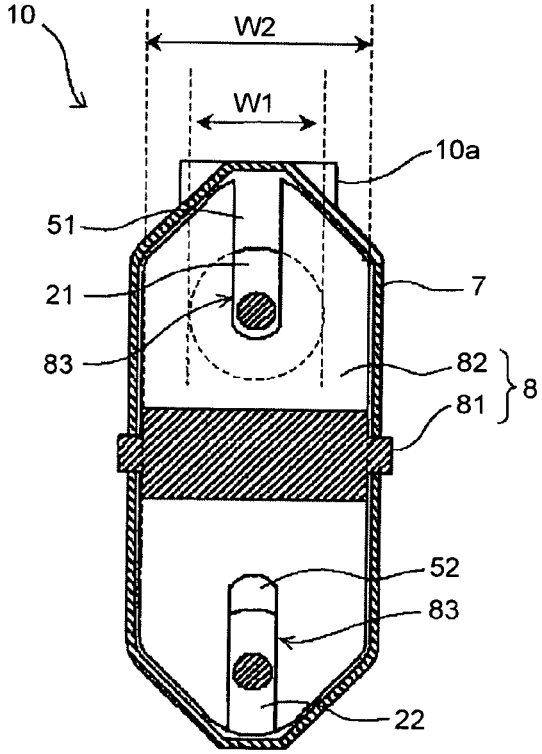

FIGS. 19A and 19B are views of the developing device 10 of Example 8. FIG. 19A is a perspective view of the developing device 10 of Example 8 and FIG. 19B is a cross-sectional view of the developing device 10 of Example 8, taken along a line as in the case of FIG. 11.

In the developing device 10 of Example 2 illustrated using FIGS. 9 to 11, the screw outer diameters of the supplying screw 21 and the collecting screw 22 and the length of the paddle blade 82 in its width direction are approximately equal. In contrast, as shown in FIG. 19B, the developing device 10 of Example 8 satisfies W1<W2, where W1 is the screw outer diameter and W2 is the length of the paddle blades 82 in its width direction.

Accordingly, the developer lifting unit 7, which functions as a stirring unit, with a large volume can be provided and this increases the volume of the developer in the developer lifting unit 7; therefore, stirring of the developer can be improved. Furthermore, the increase in the volume of the developer stored in the developer lifting unit 7 increases the volume of the developer in the developing device 10 and increase the volume of the developer corresponding to consumed toner and resupplied toner and accordingly the unevenness in the toner density can be reduced. A size-reduction of the developing device 10 reduces the total volume of the developer and shortens the life of the developer. However, by increasing the volume of the developer stored in the developer lifting unit 7, the total volume of the developer can be increased and accordingly the life of the developer can be extended.

EXAMPLE 9

A ninth example (hereinafter, "Example 9") of the developing device 10 to which the present embodiment is applied will be described below.

Figure 20:
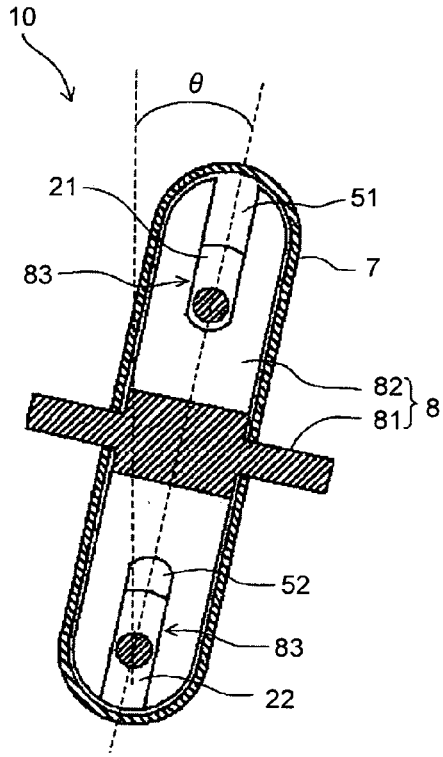
FIG. 20 is a cross-sectional view of a developing device of Example 9.

FIG. 20 illustrates the developing device 10 of Example 9. FIG. 20 is a cross-sectional view of the developing device 10 of Example 9, taken along a line as in the case in FIG. 11.

In the developing device 10 of Example 2 illustrated using FIGS. 9 to 11, the supplying-screw 21 is arranged vertically above the collecting screw 22. In contrast, in the developing device 10 of Example 9 in FIG. 20 is configured such that a virtual line connecting the rotation axes of the supplying screw 21 and the collecting screw 22 is oblique to the vertical direction by an angle θ.

The oblique by the angle θ causes a friction between the inner wall of the casing of the developer lifting unit 7 and the developer; therefore, the developer can be passed from the collecting-conveying path 52 to the supplying-conveying path 51 more efficiently compared to the configuration in which the developer is lifted vertically upward. Accordingly, the rotation number of the rotating paddle 8 can be reduced; therefore, the efficiency of lifting the developer can be improved and the stress applied to the developer can be reduced.

An increase of the angle θ increases the efficiency of lifting the developer but reduces the stirring of the developer; therefore, it is desirable that 0[°]<θ<45[°] be satisfied.

The copy machine 500 of the embodiment, to which the developing device's 10 of the examples can be applied, is a black-and-white image forming apparatus that includes the single developing device 10 and the single photosensitive element 117 as shown in FIG. 2. The developing devices 10 of the examples can be applied not only to black-and-white image forming apparatuses but to color image forming apparatuses. A normal color image forming apparatus is provided with multiple developing devices 10 (for, for example, cyan, magenta, yellow, and black) and the developing devices are arranged horizontally. An increase in the size of the developing devices in their width direction significantly increases the size of the image forming apparatus. In contrast, the developing devices 10 of the examples have the reduced-sizes in their width directions; therefore, if they are applied to color image forming apparatuses, significant space-saving can be achieved.

Modification

The developing devices 10 of Examples 1 to 5 are configured such that the developer in the casing 10*a* is conveyed by the screw members, which are arranged in the supplying-conveying path and the collecting-conveying path along the direction of the rotation axis of the developing roller 1.

The developer passing unit of the present embodiment can be applied to a configuration in which two conveying paths are arranged vertically, which configuration is not limited to one in which the developer is conveyed along the direction of the rotation axis of the developer carrier, as long as two developer conveying paths are arranged vertically and the developer is passed from the lower conveying path to the upper conveying path.

Figure 21:
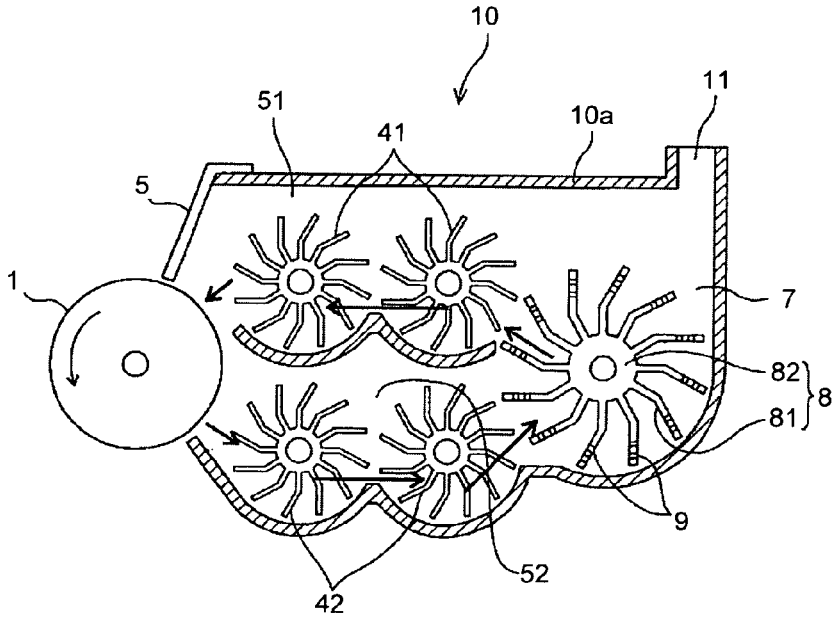
FIG. 21 is a schematic cross-sectional view of a developing device of a modification, taken along a plane orthogonal to the axial direction.

FIG. 21 is a cross-sectional view of the developing device 10 of Modification.

The arrows in FIG. 21 represent the flow of the developer in the developing device 10. In the developing device 10 of Modification, the developer in the supplying-conveying path 51 is conveyed by supplying-conveying members 41 toward the developing roller 1 (leftward in FIG. 21) in the direction orthogonal to the rotation axis of the developing roller 1. The developer is then supplied to the surface of the developing roller 1. The developer that has passed through the developing area is passed to the collecting-conveying path 52. The developer in the collecting-conveying path 52 is conveyed by a collecting-conveying member 42 in the direction (rightward in FIG. 21) in which the developer get apart from the developing roller 1, which is the direction orthogonal to the rotation axis of the developing roller 1. The developer is then passed to the developer lifting unit 7 and is passed by the rotating paddle 8, which is arranged in the developer lifting unit 7, to the upper supplying-conveying path 51.

In the rotating paddle 8 of the developing device 10 of Modification in FIG. 21, as in the case of the rotating paddles 8 of the above-described examples, the paddle blades 82 are provided with the communicating ports 9 therethrough. Accordingly, as in the case of the above-described examples, the developer lifting unit 7 can stir the developer, which improves stirring of the developer.

The above described examples are just examples and the present embodiment has unique advantage in each of the following modes.

Mode A

In a developing device including: a developer carrier (such as the developing roller 1) that carries, on its surface, a two-component developer consisting of a toner and a magnetic carrier, moves the surface, and supplies the toner to a latent image on a surface of a latent image carrier (such as the photosensitive element 117) in a developing area in which the developer carrier is opposed to the latent image carrier, thereby developing the latent image; a first conveying member (such as the supplying screw 21) that conveys the developer in a first conveying path (such as the supplying-conveying path 51) that is formed in a developer storage unit (such as the casing 10*a*) that stores the developer to be supplied to the developer carrier; a second conveying member (such as the collecting screw 22) that conveys the developer in a second conveying path (such as the collecting-conveying path 52) that is formed below the first conveying path in the developer storage unit; and a developer passing unit (such as the rotating paddle 8) that conveys upward the developer, which has reached a conveying-direction posterior end of the second conveying path, and that passes the developer to the first conveying path, the developer passing unit (such as the rotating paddle 8) includes a plurality of pushing members (such as the paddle blades 82) that push up the developer by moving up and, when the pushing members (such as the paddle blades 82) push the developer, the developer can pass from upper surfaces of the pushing members to lower surfaces of the pushing members. Accordingly, as described in the above-described examples and modification, the paddle blades 82, that rotate can convey the developer, which has been passed from the collecting-conveying path 52, to the supplying-conveying path 51 and a part of the developer can pass through the paddle blades 82; therefore, stirring of the developer in the developer lifting unit 7 can be improved. Furthermore, a speed difference occurs between the developer that passes through the paddle blades 82 and the developer that does not pass through the paddle blades 82 and thus the developers are mixed, which helps triboelectric charging; therefore, resupplied toner can be sufficiently dispersed and charged. Accordingly, while being conveyed by the rotating paddle 8 in the developer lifting unit 7, the developer can be stirred and charged. This improves dispersion and charging of the toner in the developer.

Furthermore, as described in Example 1 and Example 2, even if the supplying-conveying path 51 and the collecting-conveying path 52 are in vertically separate positions, the developer can be conveyed upward by using the rotating paddle 8; therefore, the developing roller 1, the supplying screw 21, and the collecting screw 22 can be arranged vertically in a line and accordingly the size of the developing device 10 can be reduced.

As described above, in the developing device 10 of the embodiment, the toner density of the developer and the amount of charge can be constant and the size of the developing device can be reduced. Furthermore, even if the collecting-conveying path 52 and the supplying-conveying path 51 are in vertically separate positions, the developer can be circulated stably.

The developer passing unit of the present embodiment can be applied to the configuration in which the developer is passed from the lower conveying path to the upper conveying path. The present embodiment is not limited to the configuration in which the supplying-conveying path and the circulating-conveying path are arranged vertically. For example, the developer passing unit of the present embodiment can be also applied to a configuration that includes, in addition to the supplying-conveying path and the circulating-conveying path, a collecting-conveying path along which the developer on the developer carrier is collected, which is the developer having passed through the developing area, as long as there is a portion in which the developer is passed from the lower conveying path up to the upper conveying path.

The configuration of the developer passing unit of the present embodiment is not limited to the configuration like that of the rotating paddle 8 in which the blade members fixed to the rotation shaft rotate. For example, a configuration may be used in which a plurality of plate members are fixed to an endless belt, the plate members push up the developer, and the plate members are provided with communicating ports.

The pushing members that push the developer up is not limited to a configuration in which blade members (such as the paddle blades 82) or plate members are provided with communicating ports. For example, the pushing member may be of mesh member. It is satisfactory if pushing members are used each including a portion that pushes the developer up and a communicating portion through which the developer, passes downward.

Mode B

In Mode A, the pushing members are provided with communicating portions (such as the communicating ports 9) that allow the developer to pass from the upper surfaces of the pushing members to the lower surfaces of the pushing members. Accordingly, as described in the embodiment, a configuration can be achieved that allows the developer to pass from the upper surfaces of the pushing members, such he paddle blades 82, to the lower surfaces of the pushing members.

Mode C

In Mode A or Mode B, the first conveying path is a supplying-conveying path (such as the supplying-conveying path 51) in which a supplying-conveying member (such as the supplying screw 21) is arranged that functions as the first conveying member and supplies the developer to the developer carrier while conveying the developer along a direction of an axis line of the developer carrier (such as the developing roller 1); the second conveying path is a collecting-conveying path (such as the collecting-conveying path 52) in which a collecting-conveying member (such as the collecting screw 22) is arranged that functions as the second conveying member and conveys the developer that has passed through the developing area and has been collected from the developer carrier (such as the developing roller 1); and the developer that has reached a conveying-direction posterior end of the supplying conveying path is passed to the collecting conveying path and the developer that has reached the conveying-direction posterior end of the collecting-conveying path is passed by the developer passing unit (such as the rotating paddle 8) to the supplying-conveying path so that the developer is circulated in the developer storage unit (such as the casing 10*a*). Accordingly, as described in the embodiment, the developer after the developing from which toner has been consumed in the developing area is collected in the collecting-conveying path 52 that is a conveying path different from the supplying-conveying path 51; therefore, toner density unevenness is prevented from occurring in the direction of the rotation axis of the developing roller 1.

Mode D

In Mode C, the supplying-conveying member (such as the supplying screw 21) is arranged above the developer carrier (such as the developing roller 1) and the collecting-conveying member (such as the collecting screw 22) is arranged below the developer carrier; and the supplying-conveying member, the developer carrier, and the collecting-conveying member are arranged in a straight line vertically. Accordingly, as described in Example 1 and Example 2, the length of the developing device 10 in its width direction can be reduced. Furthermore, on the virtual plane $\alpha$ connecting the rotation axes of the two screw members, the rotation member (such as the rotating paddle 8) is within a projection plane formed by the two screws; therefore, the size of the developing device 10 can be further reduced.

Mode E

In any one of Modes A to D, $S_1>S_2$ is satisfied where $S_2$ is an aperture area of an aperture (such as the developer inlet 7*b*) that leads from the second conveying path (such as the collecting-conveying path 52) to the developer passing unit (such as the rotating paddle 8) and $S_1$ is an aperture area of an aperture (such as the developer outlet 7*a*) that leads from the developer passing unit to the first conveying path (such as the supplying-conveying path 51). Accordingly, as described in Example 4, because the developer passing unit is required to have a function of passing the developer to the first conveying path (such as the supplying-conveying path) and lifting the developer against the force of gravity, the efficiency of conveying the developer from the developer passing unit (such as the rotating paddle 8) to the first conveying path (such as the supplying-conveying path 51) may be lower than the efficiency of conveying the developer from the second conveying path (such as the collecting-conveying path 52) to the developer passing unit. Setting the aperture area $S_1$ larger than $S_2$ increases the frequency in which the developer is passed from the developer passing unit (such as the rotating paddle 8) to the first conveying path (such as the supplying-conveying path 51). Accordingly, the sufficient developer can be supplied to the first conveying path (such as the supplying-conveying path 51).

Mode F

In any one of Modes A to E, the developer passing unit is a rotating member (such as the rotating paddle 8) that has a rotation shaft (such as the paddle rotation shaft 81) to which the pushing members (such as the paddle blades 82) are fixed and rotation of the rotating member on the rotation shaft changes vertical positions of the pushing members. Accordingly, as described in each of the above-described examples, a configuration for passing the developer upward can be achieved by using the simple configuration of the rotating paddle 8.

Mode G

In mode F, the first conveying member (such as the supplying screw 21) and the second conveying member (such as the collecting screw 22) are screw members each having a rotation shaft around which blades are helically provided and the two screw members are arranged so as to be approximately in parallel; and a vertical position of the rotation shaft of the rotating member (such as the rotating paddle 8) is an approximately center position between vertical positions of axial directions of the two screw members, the rotation shaft of the rotating member (such as the rotating paddle 8) is orthogonal to a virtual plane (such as the virtual plane $\alpha$) connecting the rotation shafts of the two screw members, and an outer diameter of the rotating member (such as the rotating paddle 8) is larger than a distance between the shafts of the two screw members. Accordingly, as described in Examples 1 to 6, because the paddle rotation shaft 81 is orthogonal to the virtual plane $\alpha$, a plane containing the direction of rotation of the rotating paddle 8 is parallel to the rotation shafts of the two screw members; therefore, the width of the developing device 10 in a direction orthogonal to its axial direction can be reduced. By setting the outer diameter of the rotating member (such as the rotating paddle 8) larger than the distance between the shafts of the two screw members, the efficiency of conveying the developer that is passed from the collecting-conveying path 52 is improved. Furthermore, by arranging the shaft of the rotating member (such as the rotating paddle 8) in the approximately center position between the vertical positions of directions of the shafts of the two screw members, the size of the developing device 10 in the height direction can be compact.

Mode H

In Mode F, the first conveying member (such as the supplying screw 21) and the second conveying member (such as the collecting screw 22) are screw members each having a rotation shaft around which blades are helically provided with and the two screw members are arranged so as to be approximately in parallel position; and a vertical position of the rotation shaft of the rotating member (such as the rotating paddle 8) is a position above the center between vertical positions of axial directions of the two screw members, the rotation shaft of the rotating member (such as the rotating paddle 8) is orthogonal to a virtual plane (such as the virtual plane $\alpha$) connecting the rotation shafts of the two screw members, and an outer diameter of the rotating member (such as the rotating paddle 8) is larger than a distance between the shafts of the two screw members. As described in Examples 7 and 8, the vertical position of the rotation shaft of the rotating member (such as the rotating paddle 8) is the position above the center between the vertical positions of the directions of the shafts of the two screw members, i.e., $L_1<L_2$ is satisfied as shown in FIG. 17; therefore, the pushing members (such as the paddle blades 82) cause the developer flow to and overlay on the conveying screw (such as the supplying screw 21) in the first conveying path (such as the supplying-conveying path 51) and accordingly a sufficient volume of the developer can be supplied to the first conveying path (such as the supplying-conveying path 51).

Mode I

In Mode G or Mode H, the passing aperture (such as the developer outlet 7*a*) that leads from the developer passing unit (such as the rotating paddle 8) to the first conveying path (such as the supplying-conveying path 51) is provided such that the developer is allowed to pass horizontally in the axial direction of the screw member (such as the supplying screw 21) that functions as the first conveying member; and, like the blade end curve portions 84, ends of the pushing members (such as the paddle blades 82) on their surfaces on a rotation-direction posterior side, which are ends distant from the passing aperture (such as the developer outlet 7*a*) in an axial direction of the rotation shaft, curve to the rotation-direction posterior side. Accordingly, as described in Example 5, the pushing members (such as the paddle blades 82) are curved an thus a speed component toward the first conveying path (such as the supplying-conveying path 51) is applied to the developer that is lifted from the second conveying path (such as the collecting-conveying path 52); therefore, the efficiency of conveying the developer from the rotating member (such as the rotating paddle 8) to the first conveying member (such as the supplying screw 21) can be improved and the developer can be preferably well circulated.

Mode J

In Modes G to I, a center position of the axial direction (such as the paddle rotation shaft 81) of the rotating member (such as the rotating paddle 8) approximately coincides with a position of the virtual plane (such as the virtual a). Accordingly, as described in Examples 2, 7, and 8, a projection view of the two screw members and a projection view of the rotating paddle 8 of the developer device 10 viewed from above partly coincide with each other; therefore, the size of the developing device 10 can be further reduced.

Mode K

In Modes G to J, N×R2>R1 is satisfied, where R1 [rps] is a rotation number of the first conveying member (such as the supplying screw 21), R2 [rps] is a rotation number of the rotating member (such as the rotating paddle 8), and N is a number of the pushing members (such as the paddle blades 82) that are fixed to the rotation shaft of the rotation member. Accordingly, as described in Examples 1 and 2, "N×R2" denotes the frequency of the paddle blades 82 (the number of times in which the paddle blades 82 pass per unit of time). If this frequency is smaller than the rotation number (screw pitch) of the supplying screw 21, unevenness in conveying of the developer by the paddle blades 82 tends to cause screw unevenness. For this reason, by setting the frequency of the paddle blades 82 larger than the rotation number of the supplying screw 21, the effect of unevenness in conveying of the developer by the paddle blades 82 can be reduced. Accordingly, unevenness in conveying of the developer in the supplying-conveying path 51 is reduced and the volume of the conveyed developer can be constant.

Mode L

In Modes G to K, lengths of the pushing members (such as the paddle blades 82) in a direction parallel to the rotation shaft (such as the paddle rotation shaft 81) is larger than screw diameters of the two screw members. Accordingly, as described in Example 8, by increasing the width of the developer passing unit (such as the rotating paddle 8), the volume of the developer stored in the passing unit (such as the developer lifting unit 7) can be increased and stirring of the developer in the passing unit can be improved. Furthermore, the area of the pushing members (such as the paddle blades 82) of the rotating member (such as the rotating paddle 8) is increased and the volume of the developer passed to the first developing path (such as the supplying-conveying path 51) can be increased; therefore, the developer can be preferably circulated.

Mode M

In Modes F to L, the pushing members (such as the paddle blades 82) of the rotating member (such as the rotating paddle 8) are shaped such that positions of outer circumferential ends of the pushing members are on the rotation-direction posterior side with respect to a virtual line extending in a radial direction from a position in which the pushing members are fixed to the rotation shaft (such as the paddle rotation shaft 81). Accordingly, as described in FIG. 8, by curving the tips of the paddle blades 82 in the rotation direction, the effect of scooping up the developer that is passed from the collecting-conveying path 52 can be increased; and accordingly the efficiency of conveying the developer is improved. The shape of the paddle blades 82 is not limited to the curved shape. For example, a curved shape in a cross section may be used. It is satisfactory if the positions of the outer circumferential ends 82*a* are on the rotation-direction posterior side with respect to the position of the base portion 82*b*.

Mode N

In Mode B or any one of Modes C to M including at least Mode B, positions, in one of the pushing members (such as the paddle blades 82), in which the communicating portions (such as the communicating ports 9) are provided do not coincide with positions, in a different one of the pushing members (such as the paddle blade 82) that next reaches the same level of the pushing member, in which the communicating portions (such as the communicating ports 9) are provided. For example, as shown in FIG. 11, the communicating ports 9 are provided in the paddle blade 82 in positions different from the positions of the communicating ports 9 of the adjacent paddle blade 82. Accordingly, as described in Example 2, the developer that has passed through the communicating ports 9 of the posterior paddle blade 82 (the developer that is not conveyed to the paddle blade 82 but fall) cannot easily pass through the communicating ports 9 of the next paddle blade 82. Furthermore, an operation of moving the developer in the direction of the rotation shaft of the rotating paddle 8 is given while the developer is moving in the developer lifting unit 7. This improves the stirring of developer. Furthermore, because the developer, which has passed through the spaces (such as the communicating ports 9) of the pushing members (such as the paddle blades 82) on the rotation-direction posterior side (the developer that is not conveyed but fall), cannot easily pass the spaces of the next pushing member, it increases the stirring effect.

Mode O

In an image forming apparatus (such as the copy machine 500) that includes a latent image carrier (such as the photosensitive element 117) that carries a latent image; a latent image forming unit (such as the laser light emitting device 134) that forms a latent image on the latent image carrier; and a developing unit that develops the latent image on the latent image carrier, the developing device (such as the developing device 10) of any one of Modes A to N is used as the developing unit. Accordingly, as described in the embodiments, by using the developing devices 10 of Examples 1 to 9 and Modification, the toner density of the developer used for developing and charging of the toner can be constant and accordingly preferable image forming can be performed.

The present embodiment brings an effect that the developer passing unit has the stirring function, which improves stirring of the developer while preventing the apparatus from being complicated and large.

According to the present embodiment, the pushing members of the developer passing unit push up the developer by moving up. Accordingly, the developer that has reached the conveying-direction posterior end of the second conveying path can be conveyed upward and passed to the first conveying path. Furthermore, when the pushing members push the developer, the developer can pass from the upper surfaces of the pushing members to the lower surfaces of the pushing members. Accordingly, a part of the developer that is present on the upper surface of a pushing member, excluding some developer that is pushed by the pushing member and moves up, passes through the pushing member and moves to the lower surface of the pushing member. The developer is then mixed with the developer pushed up by the following pushing member and then stirred. Accordingly, the developer passing unit has a stirring function, which improves stirring of the developer without providing an additional stirring unit; therefore, the size of the apparatus can be reduced. Furthermore, because the stirring can be improved using the simple configuration in which the developer can pass through the pushing members, the apparatus can be prevented from being complicated.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device, comprising:

a developer carrier that carries, on its surface, a two-component developer including a toner and a magnetic carrier, moves the surface, and supplies the toner to a latent image on a surface of a latent image carrier in a developing area in which the developer carrier is opposed to the latent image carrier, thereby developing the latent image;

a first conveying member that conveys the developer in a first conveying path that is formed in a developer storage unit that stores the developer to be supplied to the developer carrier;

a second conveying member that conveys the developer in a second conveying path that is formed below the first conveying path in the developer storage unit; and a developer passing unit that conveys upward the developer which has reached at a conveying-direction posterior end of the second conveying path and passes the developer to the first conveying path, wherein the developer passing unit includes a plurality of pushing members that push up the developer by moving up, and when the pushing members push the developer, the developer can pass through from upper surfaces of the pushing members to lower surfaces of the pushing members, wherein the developer passing unit is a rotating member to which the pushing members are fixed and has a rotation shaft, and rotation of the rotating member on the rotation shaft changes vertical positions of the pushing members, wherein the first conveying member and the second conveying member are of screw members each having a rotation shaft, each member being helically provided with blades, and the first conveying member and the second conveying member are arranged so as to be approximately in parallel, a vertical position of the rotation shaft of the rotating member is at an approximately center position between vertical positions of axial directions of the first conveying member and the second conveying member, the rotation shaft of the rotating member is orthogonal to a virtual plane connecting the rotation shafts of the first conveying member and the second conveying member, and an outer diameter of the rotating member is larger than a distance between the shafts of the first conveying member and the second conveying member.

2. The developing device according to claim 1, wherein the pushing members are provided with communicating portions that allow the developer to pass through from the upper surfaces of the pushing members to the lower surfaces of the pushing members.

3. The developing device according to claim 1, wherein the first conveying path is a supplying-conveying path in which a supplying-conveying member is arranged that functions as the first conveying member and supplies the developer to the developer carrier while conveying the developer along a direction of an axis line of the developer carrier, the second conveying path is a collecting-conveying path in which a collecting-conveying member is arranged that functions as the second conveying member and conveys the developer, along the direction of the axis line of the developer carrier, that has passed through the developing area and has been collected from the developer carrier, and the developer that has reached at a conveying-direction posterior end of the supplying conveying path is passed to the collecting conveying path and the developer that has reached at the conveying-direction posterior end of the collecting-conveying path is passed by the developer passing unit up to the supplying-conveying path so that the developer is circulated in the developer storage unit.

4. The developing device according to claim 3, wherein the supplying-conveying member is arranged above the developer carrier, the collecting-conveying member is arranged below the developer carrier, and the supplying-conveying member, the developer carrier, and the collecting-conveying member are arranged in a straight line vertically.

5. The developing device according to claim 1, wherein $S_1 > S_2$ is satisfied, where $S_2$ is an aperture area of an aperture that leads from the second conveying path to the developer passing unit and $S_1$ is an aperture area of an aperture that leads from the developer passing unit to the first conveying path.

6. The developing device according to claim 1, wherein a passing aperture that leads from the developer passing unit to the first conveying path is provided such that the developer is allowed to pass horizontally in the axial direction of the screw member that functions as the first conveying member, and ends of the pushing members on their surfaces on a rotation-direction posterior side, which are ends distant from the passing aperture in an axial direction of the rotation shaft, curve towards the rotation-direction posterior side.

7. The developing device according to claim 1, wherein
a center position of the axial direction of the rotating member approximately coincides with a position of the virtual plane.

8. The developing device according to claim 1, wherein
N×R2>R1 is satisfied, where R1 [rps] is the rotation number of the first conveying member, R2 [rps] is the rotation number of the rotating member, and N is the number of the pushing members fixed to the rotation shaft of the rotation member.

9. The developing device according to claim 1, wherein
a position, in one of the pushing members, in which the communicating portions are provided do not coincide with a position of a communicating portion in a different one of the pushing members that next reaches the same level of the pushing member.

10. An image forming apparatus, comprising:
a latent image carrier that carries a latent image;
a latent image forming unit that forms a latent image on the latent image carrier; and
a developing unit that develops the latent image on the latent image carrier,
wherein the developing device of claim 1 is applied thereto as the developing unit.

11. The developing device according to claim 2, wherein
a position, in one of the pushing members, in which the communicating portions are provided do not coincide with a position of a communicating portion in a different one of the pushing members that next reaches the same level of the pushing member.

12. The developing device according to claim 3, wherein
a position, in one of the pushing members, in which the communicating portions are provided do not coincide with a position of a communicating portion in a different one of the pushing members that next reaches the same level of the pushing member.

13. The developing device according to claim 5, wherein
a position, in one of the pushing members, in which the communicating portions are provided do not coincide with a position of a communicating portion in a different one of the pushing members that next reaches the same level of the pushing member.

14. A developing device, comprising:
a developer carrier that
carries, on its surface, a two-component developer including a toner and a magnetic carrier,
moves the surface, and
supplies the toner to a latent image on a surface of a latent image carrier in a developing area in which the developer carrier is opposed to the latent image carrier, thereby developing the latent image;
a first conveying member that conveys the developer in a first conveying path that is formed in a developer storage unit that stores the developer to be supplied to the developer carrier;
a second conveying member that conveys the developer in a second conveying path that is formed below the first conveying path in the developer storage unit; and
a developer passing unit that
conveys upward the developer which has reached at a conveying-direction posterior end of the second conveying path and
passes the developer to the first conveying path, wherein the developer passing unit includes a plurality of pushing members that push up the developer by moving up, and
when the pushing members push the developer, the developer can pass through from upper surfaces of the pushing members to lower surfaces of the pushing members,
wherein the developer passing unit is a rotating member to which the pushing members are fixed and has a rotation shaft, and
rotation of the rotating member on the rotation shaft changes vertical positions of the pushing members,
wherein the first conveying member and the second conveying member are screw members each having a rotation shaft around which blades are helically provided with,
the first conveying member and the second conveying member are arranged so as to be approximately in parallel,
a vertical position of the rotation shaft of the rotating member is a position above the center between vertical positions of axial directions of the the first conveying member and the second conveying member,
the rotation shaft of the rotating member is orthogonal to a virtual plane connecting the rotation shafts of the first conveying member and the second conveying member, and
an outer diameter of the rotating member is larger than a distance between the shafts of the first conveying member and the second conveying member.

15. The developing device according to claim 14, wherein
a passing aperture that leads from the developer passing unit to the first conveying path is provided such that the developer is allowed to pass horizontally in the axial direction of the screw member that functions as the first conveying member, and
ends of the pushing members on their surfaces on a rotation-direction posterior side, which are ends distant from the passing aperture in an axial direction of the rotation shaft, curve towards the rotation-direction posterior side.

16. The developing device according to claim 14, wherein
N×R2>R1 is satisfied, where R1 [rps] is the rotation number of the first conveying member, R2 [rps] is the rotation number of the rotating member, and N is the number of the pushing members fixed to the rotation shaft of the rotation member.

17. The developing device according to claim 14, wherein
length of the pushing members in a direction parallel to the rotation shaft thereof is larger than screw diameter of the first conveying member and the second conveying member.

18. A developing device, comprising:
a developer carrier that
carries, on its surface, a two-component developer including a toner and a magnetic carrier,
moves the surface, and
supplies the toner to a latent image on a surface of a latent image carrier in a developing area in which the developer carrier is opposed to the latent image carrier, thereby developing the latent image;
a first conveying member that conveys the developer in a first conveying path that is formed in a developer storage unit that stores the developer to be supplied to the developer carrier;
a second conveying member that conveys the developer in a second conveying path that is formed below the first conveying path in the developer storage unit; and a developer passing unit that conveys upward the developer which has reached at a conveying-direction posterior end of the second conveying path and passes the developer to the first conveying path, wherein the developer passing unit includes a plurality of pushing members that push up the developer by moving up, and when the pushing members push the developer, the developer can pass through from upper surfaces of the pushing members to lower surfaces of the pushing members, wherein the developer passing unit is a rotating member to which the pushing members are fixed and has a rotation shaft, and rotation of the rotating member on the rotation shaft changes vertical positions of the pushing members, and wherein the pushing members of the rotating member are shaped such that positions of outer circumferential ends of the pushing members are on the rotation-direction posterior side with respect to a virtual line extending in a radial direction from a position in which the pushing members are fixed to the rotation shaft.

* * * * *